US010731876B2

(12) United States Patent
Vandermeulen

(10) Patent No.: US 10,731,876 B2
(45) Date of Patent: Aug. 4, 2020

(54) METHODS AND SYSTEMS FOR MINI-SPLIT LIQUID DESICCANT AIR CONDITIONING

(71) Applicant: 7AC Technologies, Inc., Beverly, MA (US)

(72) Inventor: Peter F. Vandermeulen, Newburyport, MA (US)

(73) Assignee: 7AC Technologies, Inc., Beverly, MA (US)

( * ) Notice: Subject to any disclaimer, the term of this patent is extended or adjusted under 35 U.S.C. 154(b) by 83 days.

(21) Appl. No.: 16/037,675

(22) Filed: Jul. 17, 2018

(65) Prior Publication Data

US 2018/0328602 A1 Nov. 15, 2018

Related U.S. Application Data

(62) Division of application No. 14/949,116, filed on Nov. 23, 2015, now Pat. No. 10,024,558.
(Continued)

(51) Int. Cl.
*F24F 13/00* (2006.01)
*F24F 3/14* (2006.01)
(Continued)

(52) U.S. Cl.
CPC ..... *F24F 3/1417* (2013.01); *F24F 1/0003* (2013.01); *F24F 3/14* (2013.01);
(Continued)

(58) Field of Classification Search
CPC ..... F24F 1/0003; F24F 2003/1435; F24F 2003/1458; F24F 3/14; F24F 3/1417;
(Continued)

(56) References Cited

U.S. PATENT DOCUMENTS 1,791,086 A 2/1931 Sperr
2,221,787 A 11/1940 Downs et al.
(Continued)

FOREIGN PATENT DOCUMENTS

CN 100366981 C 2/2008
CN 101336358 A 12/2008
(Continued)

OTHER PUBLICATIONS

1-Open Absorption System for Cooling and Air Conditioning using Membrane Contactors—Annual Report 2005, Publication No. Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.
(Continued)

*Primary Examiner* — Filip Zec
(74) *Attorney, Agent, or Firm* — Foley Hoag LLP; Rajesh Vallabh

(57) ABSTRACT

A split liquid desiccant air conditioning system is disclosed for treating an air stream flowing into a space in a building. The split liquid desiccant air-conditioning system is switchable between operating in a warm weather operation mode wherein the system provides cooling and dehumidification, and a cold weather operation mode wherein the system provides heating and humidification, as well as into a mode wherein the system provides heated, dehumidified air to a space.

41 Claims, 20 Drawing Sheets

Related U.S. Application Data

(60) Provisional application No. 62/082,753, filed on Nov. 21, 2014.

(51) Int. Cl.
*F25B 25/00* (2006.01)
*F24F 1/0003* (2019.01)
*F25B 13/00* (2006.01)

(52) U.S. Cl.
CPC ..... *F25B 13/00* (2013.01); *F25B 25/005* (2013.01); *F24F 2003/1435* (2013.01); *F24F 2003/1458* (2013.01); *F25B 2313/02732* (2013.01); *F25B 2313/02741* (2013.01)

(58) Field of Classification Search
CPC ..... F25B 13/00; F25B 2313/02732; F25B 2313/02741; F25B 25/005
See application file for complete search history.

(56) References Cited

U.S. PATENT DOCUMENTS 2,235,322 A 3/1941 Martin
2,433,741 A 12/1947 Crawford
2,634,958 A 4/1953 Simpelaar
2,660,159 A 11/1953 Hughes
2,708,915 A 5/1955 Mandelburg
2,939,686 A 6/1960 Wildermuth
2,988,171 A 6/1961 Arnold et al.
3,119,446 A 1/1964 Weiss
3,193,001 A 7/1965 Meckler
3,276,634 A 10/1966 Arnot
3,409,969 A 11/1968 Simons
3,410,581 A 11/1968 Christensen
3,455,338 A 7/1969 Pollit
3,718,181 A 2/1973 Reilly et al.
4,100,331 A 7/1978 Fletcher et al.
4,164,125 A 8/1979 Griffiths
4,176,523 A 12/1979 Rousseau
4,205,529 A 6/1980 Ko
4,209,368 A 6/1980 Coker et al.
4,222,244 A 9/1980 Meckler
4,235,221 A 11/1980 Murphy
4,239,507 A 12/1980 Benoit et al.
4,259,849 A 4/1981 Griffiths
4,324,947 A 4/1982 Dumbeck
4,399,862 A 8/1983 Hile
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,660,390 A 4/1987 Worthington
4,691,530 A 9/1987 Meckler
4,703,629 A 11/1987 Moore
4,730,600 A 3/1988 Harrigill
4,744,414 A 5/1988 Schon
4,766,952 A 8/1988 Onodera
4,786,301 A 11/1988 Rhodes
4,832,115 A 5/1989 Albers et al.
4,872,578 A 10/1989 Fuerschbach et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,971,142 A 11/1990 Mergler
4,976,313 A 12/1990 Dahlgren et al.
4,979,965 A 12/1990 Sannholm
4,984,434 A 1/1991 Peterson et al.
4,987,750 A 1/1991 Meckler
5,005,371 A 4/1991 Yonezawa et al.
5,181,387 A 1/1993 Meckler
5,182,921 A 2/1993 Yan
5,186,903 A 2/1993 Cornwell
5,191,771 A 3/1993 Meckler
5,221,520 A 6/1993 Cornwell
5,351,497 A 10/1994 Lowenstein
5,361,828 A 11/1994 Lee et al.
5,375,429 A 12/1994 Tokizaki et al.
5,448,895 A * 9/1995 Coellner ..... F24F 3/1411 62/271
5,462,113 A 10/1995 Wand
5,471,852 A 12/1995 Meckler
5,528,905 A 6/1996 Scarlatti
5,534,186 A 7/1996 Walker et al.
5,582,026 A 12/1996 Barto, Sr.
5,595,690 A 1/1997 Filburn et al.
5,605,628 A 2/1997 Davidson et al.
5,606,865 A 3/1997 Caron
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,816,065 A 10/1998 Maeda
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
5,950,442 A 9/1999 Maeda et al.
6,012,296 A 1/2000 Shah
6,018,954 A 2/2000 Assaf
6,035,657 A 3/2000 Dobak, III et al.
6,083,387 A 7/2000 LeBlanc et al.
6,103,969 A 8/2000 Bussey
6,131,649 A 10/2000 Pearl et al.
6,134,903 A 10/2000 Potnis et al.
6,138,470 A 10/2000 Potnis et al.
6,156,102 A 12/2000 Conrad et al.
6,171,374 B1 1/2001 Barton et al.
6,216,483 B1 4/2001 Potnis et al.
6,216,489 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 9/2002 Maeda et al.
6,463,750 B2 10/2002 Assaf
6,487,872 B1 12/2002 Forkosh et al.
6,488,900 B1 12/2002 Call et al.
6,497,107 B2 12/2002 Maisotsenko et al.
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 4/2003 Forkosh et al.
6,557,365 B2 5/2003 Dinnage et al.
6,660,069 B2 12/2003 Sato et al.
6,684,649 B1 2/2004 Thompson
6,739,142 B2 5/2004 Korin
6,745,826 B2 6/2004 Lowenstein et al.
6,766,817 B2 7/2004 da Silva et al.
6,848,265 B2 2/2005 Lowenstein et al.
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,945,065 B2 * 9/2005 Lee ..... F24F 3/1417 165/45
6,976,365 B2 12/2005 Forkosh et al.
6,986,428 B2 1/2006 Hester et al.
7,066,586 B2 6/2006 da Silva et al.
RE39,288 E 9/2006 Assaf
7,143,597 B2 12/2006 Hyland et al.
7,191,821 B2 3/2007 Gronwall et al.
7,197,887 B2 4/2007 Maisotsenko et al.

(56) References Cited

U.S. PATENT DOCUMENTS 7,228,891 B2 6/2007 Shin et al.
7,258,923 B2 8/2007 van den Bogerd et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf
7,758,671 B2 7/2010 Kesten et al.
7,930,896 B2 * 4/2011 Matsui ..... F24F 1/0003 62/238.3
7,938,888 B2 5/2011 Assaf
8,141,379 B2 3/2012 Al-Hadhrami et al.
8,337,590 B2 12/2012 Herencia et al.
8,353,175 B2 1/2013 Wohlert
8,496,732 B2 7/2013 Culp et al.
8,499,576 B2 8/2013 Meijer
8,500,960 B2 8/2013 Ehrenberg et al.
8,623,210 B2 1/2014 Manabe et al.
8,641,806 B2 2/2014 Claridge et al.
8,648,209 B1 2/2014 Lastella
8,695,363 B2 4/2014 Tang et al.
8,696,805 B2 4/2014 Chang et al.
8,769,971 B2 7/2014 Kozubal et al.
8,790,454 B2 7/2014 Lee et al.
8,800,308 B2 8/2014 Vandermeulen et al.
8,876,943 B2 11/2014 Gottlieb et al.
8,881,806 B2 11/2014 Xie et al.
8,943,844 B2 2/2015 Forkosh
8,943,850 B2 2/2015 Vandermeulen et al.
8,968,945 B2 3/2015 Fasold et al.
9,000,289 B2 4/2015 Vandermeulen et al.
9,086,223 B2 7/2015 Vandermeulen et al.
9,101,874 B2 8/2015 Vandermeulen
9,101,875 B2 8/2015 Vandermeulen et al.
9,243,810 B2 1/2016 Vandermeulen et al.
9,273,877 B2 3/2016 Vandermeulen et al.
9,308,490 B2 4/2016 Vandermeulen et al.
9,377,207 B2 6/2016 Vandermeulen et al.
9,429,332 B2 8/2016 Vandermeulen et al.
9,470,426 B2 10/2016 Vandermeulen
9,506,697 B2 11/2016 Vandermeulen
9,631,823 B2 4/2017 Vandermeulen et al.
9,631,848 B2 4/2017 Vandermeulen et al.
9,709,285 B2 7/2017 Vandermeulen
9,709,286 B2 7/2017 Vandermeulen et al.
9,835,340 B2 12/2017 Vandermeulen et al.
10,006,648 B2 6/2018 Vandermeulen et al.
10,024,558 B2 7/2018 Vandermeulen
10,024,601 B2 7/2018 Vandermeulen
1,016,805 A1 1/2019 Vandermeulen
10,323,867 B2 6/2019 Vandermeulen
2001/0008148 A1 7/2001 Ito et al.
2001/0013226 A1 8/2001 Potnis et al.
2001/0015500 A1 8/2001 Shimanuki et al.
2002/0023740 A1 2/2002 Lowenstein et al.
2002/0026797 A1 3/2002 Sundhar
2002/0038552 A1 4/2002 Maisotsenko et al.
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0033821 A1 2/2003 Maisotsenko et al.
2003/0051498 A1 3/2003 Sanford
2003/0106680 A1 6/2003 Serpico et al.
2003/0121271 A1 7/2003 Dinnage et al.
2003/0209017 A1 11/2003 Maisotsenko et al.
2003/0230092 A1 12/2003 Lowenstein et al.
2004/0040697 A1 3/2004 Pierre et al.
2004/0061245 A1 4/2004 Maisotsenko et al.
2004/0101698 A1 5/2004 Yamanaka et al.
2004/0109798 A1 6/2004 Chopard et al.
2004/0112077 A1 6/2004 Forkosh et al.
2004/0118125 A1 6/2004 Potnis et al.
2004/0134212 A1 7/2004 Lee et al.
2004/0168462 A1 9/2004 Assaf
2004/0194944 A1 10/2004 Hendricks et al.
2004/0211207 A1 10/2004 Forkosh et al.
2004/0230092 A1 11/2004 Thierfelder et al.
2004/0231512 A1 11/2004 Slayzak et al.
2004/0261440 A1 12/2004 Forkosh et al.
2005/0095433 A1 5/2005 Bogerd et al.
2005/0106021 A1 5/2005 Bunker et al.
2005/0109052 A1 5/2005 Albers et al.
2005/0133082 A1 6/2005 Konold et al.
2005/0210907 A1 9/2005 Gillan et al.
2005/0217485 A1 10/2005 Olapinski et al.
2005/0218535 A1 10/2005 Maisotsenko et al.
2005/0257551 A1 11/2005 Landry
2006/0042295 A1 3/2006 Assaf
2006/0070728 A1 4/2006 Shin et al.
2006/0124287 A1 6/2006 Reinders
2006/0156750 A1 7/2006 Lowenstein et al.
2006/0156761 A1 7/2006 Mola et al.
2006/0278089 A1 12/2006 Theilow
2007/0169916 A1 7/2007 Wand et al.
2007/0175234 A1 8/2007 Pruitt
2007/0234743 A1 10/2007 Assaf
2008/0127965 A1 6/2008 Burton
2008/0156471 A1 7/2008 Han et al.
2008/0196758 A1 8/2008 McGuire
2008/0203866 A1 8/2008 Chamberlain
2008/0302357 A1 12/2008 DeNault
2008/0314567 A1 12/2008 Noren
2009/0000732 A1 1/2009 Jacobine et al.
2009/0056919 A1 3/2009 Hoffman et al.
2009/0095162 A1 4/2009 Hargis et al.
2009/0126913 A1 5/2009 Lee et al.
2009/0173096 A1 7/2009 Wohlert
2009/0183857 A1 7/2009 Pierce et al.
2009/0200022 A1 8/2009 Bravo et al.
2009/0238685 A1 9/2009 Santa Ana
2010/0000247 A1 1/2010 Bhatti et al.
2010/0012309 A1 1/2010 Uges
2010/0018322 A1 1/2010 Neitzke et al.
2010/0051083 A1 3/2010 Boyk
2010/0077783 A1 4/2010 Bhatti et al.
2010/0084120 A1 4/2010 Yin et al.
2010/0170776 A1 7/2010 Ehrenberg et al.
2010/0319370 A1 12/2010 Kozubal et al.
2011/0073290 A1 3/2011 Chang et al.
2011/0100618 A1 5/2011 Carlson
2011/0101117 A1 5/2011 Miyauchi et al.
2011/0126885 A1 6/2011 Kokotov et al.
2011/0132027 A1 6/2011 Gommed et al.
2012/0052785 A1 3/2012 Nagamatsu et al.
2012/0114527 A1 5/2012 Hoglund et al.
2012/0118148 A1 5/2012 Culp et al.
2012/0118155 A1 5/2012 Claridge et al.
2012/0125020 A1 5/2012 Vandermeulen et al.
2012/0125021 A1 5/2012 Vandermeulen et al.
2012/0125031 A1 5/2012 Vandermeulen et al.
2012/0125581 A1 5/2012 Allen et al.
2012/0131937 A1 5/2012 Vandermeulen et al.
2012/0131938 A1 5/2012 Vandermeulen et al.
2012/0131939 A1 5/2012 Vandermeulen et al.
2012/0132513 A1 5/2012 Vandermeulen et al.
2012/0152318 A1 6/2012 Kee
2012/0186281 A1 7/2012 Vandermeulen et al.
2013/0056177 A1 3/2013 Coutu et al.
2013/0101909 A1 4/2013 Fasold et al.
2013/0186121 A1 7/2013 Erb et al.
2013/0199220 A1 8/2013 Ma et al.
2013/0227982 A1 9/2013 Forkosh
2013/0255287 A1 10/2013 Forkosh
2013/0340449 A1 12/2013 Kozubal et al.
2014/0054004 A1 2/2014 LePoudre et al.
2014/0054013 A1 2/2014 LePoudre et al.
2014/0150481 A1 6/2014 Vandermeulen
2014/0150656 A1 6/2014 Vandermeulen
2014/0150657 A1 6/2014 Vandermeulen et al.
2014/0150662 A1 6/2014 Vandermeulen et al.

(56) References Cited

U.S. PATENT DOCUMENTS

| | | | |
|---|---|---|---|
| 2014/0223947 | A1 | 8/2014 | Ranjan et al. |
| 2014/0245769 | A1 | 9/2014 | Vandermeulen et al. |
| 2014/0250935 | A1 | 9/2014 | Prochaska et al. |
| 2014/0260367 | A1 | 9/2014 | Coutu et al. |
| 2014/0260369 | A1 | 9/2014 | LePoudre |
| 2014/0260371 | A1 | 9/2014 | Vandermeulen |
| 2014/0260398 | A1 | 9/2014 | Kozubal et al. |
| 2014/0260399 | A1 | 9/2014 | Vandermeulen |
| 2014/0262125 | A1 | 9/2014 | Erb et al. |
| 2014/0262144 | A1 | 9/2014 | Erb et al. |
| 2014/0264968 | A1 | 9/2014 | Erb et al. |
| 2014/0360373 | A1 | 12/2014 | Peacos et al. |
| 2014/0366567 | A1 | 12/2014 | Vandermeulen |
| 2015/0107287 | A1 | 4/2015 | Forkosh |
| 2015/0184876 | A1 | 7/2015 | Vandermeulen et al. |
| 2015/0300754 | A1 | 10/2015 | Vandermeulen et al. |
| 2015/0323216 | A1 | 11/2015 | Wallin |
| 2015/0338140 | A1 | 11/2015 | Vandermeulen |
| 2016/0187011 | A1 | 6/2016 | Vandermeulen |
| 2016/0290665 | A1 | 10/2016 | Vandermeulen et al. |
| 2017/0074530 | A1 | 3/2017 | Kozubal |
| 2017/0102155 | A1 | 4/2017 | Vandermeulen |
| 2017/0106639 | A1 | 4/2017 | Vandermeulen et al. |
| 2017/0167794 | A1 | 6/2017 | Vandermeulen |
| 2017/0184319 | A1 | 6/2017 | Vandermeulen et al. |
| 2017/0292722 | A1 | 10/2017 | Vandermeulen |
| 2018/0051897 | A1 | 2/2018 | Vandermeulen et al. |
| 2018/0163977 | A1 | 6/2018 | Vandermeulen |

FOREIGN PATENT DOCUMENTS

| | | | |
|---|---|---|---|
| CN | 100476308 | C | 4/2009 |
| CN | 101636630 | A | 1/2010 |
| CN | 102282426 | A | 12/2011 |
| CN | 202229469 | U | 5/2012 |
| EP | 0781972 | A2 | 7/1997 |
| EP | 1120609 | A1 | 8/2001 |
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| EP | 2787293 | A1 | 10/2014 |
| GB | 1172247 | A | 11/1969 |
| JP | S54-77443 | A | 6/1979 |
| JP | S62-297647 | A | 12/1987 |
| JP | 02306067 | A | 12/1990 |
| JP | H03-125830 | A | 5/1991 |
| JP | H03-213921 | A | 9/1991 |
| JP | H08-105669 | A | 4/1996 |
| JP | H09-184692 | A | 7/1997 |
| JP | H10-220914 | A | 8/1998 |
| JP | H11-137948 | A | 5/1999 |
| JP | H11-197439 | A | 7/1999 |
| JP | H11-351700 | A | 12/1999 |
| JP | 2000-230730 | A | 8/2000 |
| JP | 2001-517773 | A | 10/2001 |
| JP | 2002-206834 | A | 7/2002 |
| JP | 2004-524504 | A | 8/2004 |
| JP | 2005-134060 | A | 5/2005 |
| JP | 2006-263508 | A | 10/2006 |
| JP | 2006-529022 | A | 12/2006 |
| JP | 2008-020138 | A | 1/2008 |
| JP | 2009-517622 | A | 4/2009 |
| JP | 2009-04273555 | B2 | 6/2009 |
| JP | 2009-180433 | A | 8/2009 |
| JP | 2009-192101 | A | 8/2009 |
| JP | 2009-281668 | A | 12/2009 |
| JP | 2009-293831 | A | 12/2009 |
| JP | 201054136 | A | 3/2010 |
| JP | 2010-247022 | A | 11/2010 |
| JP | 2011-064359 | A | 3/2011 |
| JP | 2011-511244 | A | 4/2011 |
| JP | 201192815 | A | 5/2011 |
| JP | 2011-163682 | A | 8/2011 |
| JP | 2012-073013 | A | 4/2012 |
| JP | 2013-064549 | A | 4/2013 |
| KR | 10-2001-0017939 | A | 3/2001 |
| KR | 2004-0026242 | A | 3/2004 |
| KR | 10-0510774 | B1 | 8/2005 |
| KR | 2014-0022785 | A | 2/2014 |
| TW | 201009269 | A | 3/2010 |
| WO | WO-1997021061 | A1 | 6/1997 |
| WO | WO-1999022180 | A1 | 5/1999 |
| WO | WO-2000011426 | A1 | 3/2000 |
| WO | WO-2000055546 | A1 | 9/2000 |
| WO | WO-2002066901 | A1 | 8/2002 |
| WO | WO-2002086391 | A1 | 10/2002 |
| WO | WO-2003004937 | A1 | 1/2003 |
| WO | WO-2004046618 | A1 | 6/2004 |
| WO | WO-2006006177 | A1 | 1/2006 |
| WO | WO-2008037079 | A1 | 4/2008 |
| WO | WO-2009094032 | A1 | 7/2009 |
| WO | WO-2009144880 | A1 | 12/2009 |
| WO | WO-2009157277 | A1 | 12/2009 |
| WO | WO-2011062808 | A1 | 5/2011 |
| WO | WO-2011150081 | A2 | 12/2011 |
| WO | WO-2011161547 | A2 | 12/2011 |
| WO | WO-2012071036 | A1 | 5/2012 |
| WO | WO-2012082093 | A1 | 6/2012 |
| WO | WO-2013172789 | A1 | 11/2013 |
| WO | WO-2014152905 | A1 | 9/2014 |
| WO | WO-2014201281 | A1 | 12/2014 |
| WO | WO-2015077364 | A1 | 5/2015 |

OTHER PUBLICATIONS

2-Open Absorption System for Cooling and Air Conditioning using Membrane Contactors—Annual, Report 2006, Publication No. Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

3-Open Absorption System for Cooling and Air Conditioning Using Membrane Contactors—Final Report, Publication No. Publication 280139, Project: 101310—Open Absorption System for Cooling and Air Conditioning using Membrane Contactors, Date of publication: Jul. 8, 2008, Author: Viktor Dorer, Manuel Conde-Petit, Robert Weber, Contractor: M. Conde Engineering.

4-Conde-Petit, M. 2007. Liquid Desiccant-Based Air-Conditioning Systems—LDACS, Proc. of the 1st European Conference on Polygeneration—Technologies and Applications, 217-234, A. Coronas, ed., Tarragona-Spain, Oct. 16-17, Published by CREVER—Universitat Rovira I Virgili, Tarragona, Spain.

5-Conde-Petit, M. 2008. Open Absorption Systems for Air-Conditioning using Membrane Contactors,Proceedings '15. Schweizerisches Status-Seminar «Energie- und Umweltforschung im Bauwesen»', Sep. 11-12—ETH Zurich, Switzerland. Published by Brenet—Eggwilstr. 16a, CH-9552 Bronschhofen—Switzerland (brenet@vogel-tech.ch).

6-Third Party Observations for PCT/US2011/037936, dated Sep. 24, 2012.

Ashrae, et al., "Desiccant Dehumidification and Pressue Drying Equipment," 2012 ASHERAE Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

Fimbres-Weihs, et al., "Review of 3D CFD modeling of flow and mass transfer in narrow spacer-filled channels in membrane modules," Chemical Engineering and Processing 49 (2010) pp. 759-781.

Lowenstein, "A Solar Liquid-Desiccant Air Conditioner," Solar 2003, Proceedings of the 32nd ASES Annual Conference, Austin, TX, Jul. 2003.

Li, F., et al., "Novel spacers for mass transfer enhancement in membrane separations," Journal of Membrane Science, 253 (2005), pp. 1-12.

Li, Y., et al., "CFD simulation of fluid flow through spacer-filled membrane module: selecting suitable cell types for periodic boundary conditions," Desalination 233 (2008) pp. 351-358.

(56) References Cited

OTHER PUBLICATIONS

Liu, et al., "Research Progress in Liquid Desiccant Air Conditioning Devices and Systems," Frontiers of Energy and Power Engineering in China, vol. 4, Issue 1, pp. 55-65, Feb. 2010.
Mathioulakis, "Desalination by Using Alternative Energy," Desalination, Issue 203, pp. 346-365, 2007.
Russell, et al., "Optimization of Photovolatic Thermal Collector Heat Pump Systems," ISES International Solar Energy Conference, Atlanta, GA, vol. 3, pp. 1870-1874, May 1979.
Perry "Perry's Chemical Engineers handbook" 1999 McGraw Hill p. 11-52,11-53.
"Siphon." Encyclopedia Americana. Grolier Online, 2015. Web. Apr. 3, 2015. 1 page.
Welty, "Liquid Desiccant Dehumidification," Engineered Systems, May 2010, vol. 27 Issue 5, p. 34.
International Search Report and Written Opinion for PCT/US2015/062117, dated Mar. 16, 2016.
Extended European Search Report for EP Application No. 15861611.0 dated May 25, 2018.
Random House Kernerman Webster's College Dictionary, "Refrigerant," Random House, <https://thefreedictionary.com/refrigerant> (2010).
Lachner, "An Investigation into the Feasibility of the Use of Water as a Refrigerant," International Refrigeration and Air Conditioning Conference, 723:1-9 (2004).

* cited by examiner

METHODS AND SYSTEMS FOR MINI-SPLIT LIQUID DESICCANT AIR CONDITIONING

CROSS REFERENCE TO RELATED APPLICATIONS

This application is a division of U.S. patent application Ser. No. 14/949,116 (issued as U.S. Pat. No. 10,024,558) filed on Nov. 23, 2015 entitled METHODS AND SYSTEMS FOR MINI-SPLIT LIQUID DESICCANT AIR CONDITIONING, which claims priority from U.S. Provisional Patent Application No. 62/082,753 filed on Nov. 21, 2014 entitled METHODS AND SYSTEMS FOR MINI-SPLIT LIQUID DESICCANT AIR CONDITIONING, both of which applications are hereby incorporated by reference.

BACKGROUND

The present application relates generally to the use of liquid desiccants to dehumidify and cool, or heat and humidify an air stream entering a space. More specifically, the application relates to the replacement of conventional mini-split air conditioning units with (membrane based) liquid desiccant air conditioning system to accomplish the same heating and cooling capabilities as those conventional mini-split air conditioners and at the same time to provide additional functionality such as, for example, the ability for the system to heat and simultaneously humidify the space or for the system to heat and simultaneously dehumidify a space thereby providing for healthier indoor air conditions than conventional systems will provide.

Desiccant dehumidification systems—both liquid and solid desiccants—have been used parallel to conventional vapor compression HVAC equipment to help reduce humidity in spaces, particularly in spaces that require large amounts of outdoor air or that have large humidity loads inside the building space itself. (ASHRAE 2012 Handbook of HVAC Systems and Equipment, Chapter 24, p. 24.10). Humid climates, such as for example Miami, Fla. require a lot of energy to properly treat (dehumidify and cool) the fresh air that is required for a space's occupant comfort. Desiccant dehumidification systems—both solid and liquid—have been used for many years and are generally quite efficient at removing moisture from the air stream. However, liquid desiccant systems generally use concentrated salt solutions such as ionic solutions of LiCl, LiBr or $CaCl_2$ and water. Such brines are strongly corrosive to metals, even in small quantities, so numerous attempts have been made over the years to prevent desiccant carry-over to the air stream that is to be treated. In recent years efforts have begun to eliminate the risk of desiccant carry-over by employing micro-porous membranes to contain the desiccant solution. These membrane based liquid desiccant systems have been primarily applied to unitary rooftop units for commercial buildings. However, residential and small commercial buildings often use mini-split air conditioners wherein the condenser (together with the compressor and control system) is located outside and the evaporator cooling coil is installed in the room or space than needs to be cooled, and unitary rooftop units are not an appropriate choice for servicing those spaces. In Asia in particular (which is generally hot and humid) the mini-split air conditioning system is the preferred method of cooling (and sometimes heating) a space.

Liquid desiccant systems generally have two separate functions. The conditioning side of the system provides conditioning of air to the required conditions, which are typically set using thermostats or humidistats. The regeneration side of the system provides a reconditioning function of the liquid desiccant so that it can be re-used on the conditioning side. Liquid desiccant is typically pumped or moved between the two sides, and a control system helps to ensure that the liquid desiccant is properly balanced between the two sides as conditions necessitate and that excess heat and moisture are properly dealt with without leading to over-concentrating or under-concentrating of the desiccant.

Mini-split systems typically take in 100% of room air through the evaporator coil and fresh air only reaches the room through ventilation and infiltration from other sources. This often can result in high humidity and cool temperatures in the space since the evaporator coil is not very efficient for removing moisture. Rather, the evaporator coil is better suited for sensible cooling. On days where only a small amount of cooling is required, the building can reach unacceptable levels of humidity since not enough natural heat is available to balance the large amount of sensible cooling. Equally on colder humid days, such as in the rainy season, heating the air would be preferred while also dehumidifying it. Mini-split systems are typically unable to provide dehumidification, although they will provide heating if they are setup as a heat pump.

In many smaller buildings a small evaporator coil is hung high up on a wall or is covered by a painting as for example the LG LAN126HNP Art Cool Picture frame. A condenser with compressor is installed outside and high pressure refrigerant lines connect the two components. Furthermore a drain line for condensate is installed on the indoor coil unit to remove moisture that is condensed on the evaporator coil to the outside. A liquid desiccant system can significantly reduce electricity consumption and can be easier to install without the need for high pressure refrigerant lines. The advantage of such an approach is that a significant portion of the cost of a mini-split system is the actual installation (the running, filling and testing of refrigerant line) that need to be installed on site. Furthermore, since the refrigerant lines run into the space, the refrigerant selections are limited to non-flammable and non-toxic substances. By keeping all of the refrigerant components outside, the number of available refrigerants can be expanded to include ones that otherwise would not be allowed, such as propane etc.

There thus remains a need to provide a retrofittable cooling system for small buildings with high humidity loads, wherein the cooling and dehumidification of indoor air can be accommodated at low capital and energy costs.

BRIEF SUMMARY

Provided herein are methods and systems used for the efficient cooling and dehumidification of an air stream especially in small commercial or residential buildings using a mini-split liquid desiccant air conditioning system. In accordance with one or more embodiments, the liquid desiccant flows down the face of a support plate as a falling film. In accordance with one or more embodiments, the desiccant is contained by a microporous membrane and the air stream is directed in over the surface of the membrane and whereby both latent and sensible heat are absorbed from the air stream into the liquid desiccant. In accordance with one or more embodiments, the support plate is filled with a heat transfer fluid that ideally is flowing in a direction counter to the air stream. In accordance with one or more embodiments, the system comprises a conditioner that removes latent and sensible heat through the liquid desiccant into the heat transfer fluid and a regenerator that rejects the latent and sensible heat from the heat transfer fluid to another environment and a heat dump coil that rejects excess heat to the other environment as well. In accordance with one or more embodiments the system is able to provide cooling and dehumidification in a summer cooling mode, humidification and heating in a winter operating mode and heating and dehumidification in a rainy season mode.

In accordance with one or more embodiments, in a summer cooling and dehumidification mode, the heat transfer fluid in the conditioner is cooled by a refrigerant compressor. In accordance with one or more embodiments, the heat transfer fluid in the regenerator is heated by a refrigerant compressor. In accordance with one or more embodiments, the refrigerant compressor is reversible to provide heated heat transfer fluid to the conditioner and cold heat transfer fluid to the regenerator and the conditioned air is heated and humidified and the regenerated air is cooled and dehumidified. In accordance with one or more embodiments, the conditioner is mounted against a wall in a space and the regenerator and heat dump coil are mounted outside of the building. In accordance with one or more embodiments, the regenerator supplies concentrated liquid desiccant to the conditioner through a heat exchanger. In one or more embodiments, the conditioner receives 100% room air. In one or more embodiments, the regenerator receives 100% outside air. In one or more embodiments the heat dump coil receives 100% outside air. In accordance with one or more embodiments a heat exchanger receives hot refrigerant and sends hot heat transfer fluid to a regenerator, while at the same time hot refrigerant is also directed to a heat dump coil and a cold refrigerant is used to send cold heat transfer fluid to a conditioner where cool, dehumidified air is created. In accordance with one or more embodiments there is a set of four 3- and one 4-way refrigerant valves that allows the hot refrigerant to be switched to heat the previously cold heat transfer fluid in a winter operating mode so that the conditioner receives the now hot heat transfer fluid and the cold heat transfer fluid is directed to the heat dump coil and regenerator. In accordance with one or more embodiments the set of refrigerant valves can also be switched so that the hot refrigerant is directed to the heat exchanger in a rainy season mode, wherein the hot refrigerant creates a hot heat transfer fluid for a regenerator, while at the same time the valving system is directing cold refrigerant to the heat dump coil and the conditioner receives no heat transfer fluid so that liquid desiccant in the conditioner absorbs moisture adiabatically.

In accordance with one or more embodiments the refrigerant valves contain a set of two 4-way and one bypass valve. In accordance with one or more embodiments the first 4-way valve is switched so that hot refrigerant from a compressor flows to a first heat exchanger and then to the second 4-way valve, from which it flows to a heat dump coil, through an expansion valve and to a second heat exchanger before flowing back to the first 4-way valve in a summer cooling and dehumidification mode. In one or more embodiments the first heat exchanger is coupled by means of a heat transfer fluid to a regenerator. In one or more embodiments the regenerator is a 3-way liquid desiccant membrane regenerator. In one or more embodiments the regenerator delivers concentrated liquid desiccant to a conditioner. In one or more embodiments the second heat exchanger is coupled by means of a heat transfer fluid to a conditioner. In one or more embodiments, the conditioner is a 3-way liquid desiccant membrane conditioner. In one or more embodiments, the conditioner receives concentrated liquid desiccant from a regenerator. In accordance with one or more embodiments the first 4-way valve can be switched to a winter heating and humidification mode such that the hot refrigerant first flows to the second heat exchanger, then through an expansion valve into the heat dump coil and through the second 4-way valve to the first heat exchanger and through the first 4-way valve back through the compressor. In accordance with one or more embodiments the first 4-way valve is switched so that hot refrigerant from a compressor flows to a first heat exchanger, through a second 4-way valve through an expansion valve and the now cold refrigerant flows through a heat dump coil where heat is added to the cold refrigerant by the coil, after which the refrigerant flows through the second 4-way valve through the bypass valve, back through the first 4-way valve to the compressor in a rainy season heating and dehumidification mode. In one or more embodiments, the first heat exchanger is coupled by means of a heat transfer fluid to a regenerator. In one or more embodiments, the regenerator is a 3-way liquid desiccant membrane regenerator. In one or more embodiments, the regenerator delivers concentrated liquid desiccant to a conditioner. In one or more embodiments, the second heat exchanger is coupled by means of a heat transfer fluid to a conditioner. In one or more embodiments, the conditioner is a 3-way liquid desiccant membrane conditioner. In one or more embodiments, the conditioner receives concentrated liquid desiccant from a regenerator. In one or more embodiments, the conditioner is only receiving concentrated desiccant from the regenerator but no heat transfer fluid is flowing in the rainy season mode.

In accordance with one or more embodiments a compressor delivers a hot refrigerant through a 4-way valve into a first heat exchanger where a hot heat transfer fluid is created in a summer cooling mode. The cooled refrigerant is then directed through a first expansion valve where it become cold to a second heat exchanger where it creates a cold heat transfer fluid. The hot heat transfer fluid in the first heat exchanger is directed through means of a series of valves to a liquid desiccant regenerator, where a concentrated liquid desiccant is produced as well as to a heat dump coil where excess heat can be rejected. In one or more embodiments, the regenerator and heat dump coil are located outside a building. In one or more embodiments, the regenerator is a 3-way liquid desiccant membrane regenerator. The cold heat transfer fluid in the second heat exchanger is directed through a series of valves to a liquid desiccant conditioner where a concentrated liquid desiccant is received and used to dehumidify an air stream. In one or more embodiments, the conditioner is a 3-way liquid desiccant membrane conditioner. In one or more embodiments, the conditioner is located inside a building. In one or more embodiments, the 4-way valve can be switched so that the hot refrigerant is directed to the second heat exchanger in a winter heating and humidification mode. In one or more embodiments, the second heat exchanger delivers a hot heat transfer fluid to a conditioner which in turn creates a warm, humid air stream for heating and humidifying a space. In one or more embodiments, the conditioner is a 3-way liquid desiccant membrane conditioner. In one or more embodiments, the conditioner is located inside a building. In one or more embodiments, the cooler refrigerant leaving the second heat exchanger is directed through a second expansion valve and the cold refrigerant is not directed to the first heat exchanger wherein a cold heat transfer fluid is created. The cold heat transfer fluid in the first heat exchanger is now directed to a regenerator where heat and moisture are removed from an air stream and a heat dump coil where additional heat can be picked up from a second air stream. In one or more embodiments, the regenerator and heat dump coil are located outside a building. In one or more embodiments, the regenerator is a 3-way liquid desiccant membrane regenerator. In accordance with one or more embodiments a compressor delivers a hot refrigerant flowing through the 4-way valve to a first heat exchanger wherein a hot heat transfer fluid is created. The hot heat transfer fluid can be re-directed by the series of valves to flow to the regenerator only in a rainy season operating mode. The cooler refrigerant now flows through an expansion valve wherein the refrigerant gets cold and flows to a second heat exchanger wherein a cold heat transfer fluid is created. The cold heat transfer fluid in the second heat exchanger can be now be directed to the heat transfer coil. In one or more embodiments, the regenerator receives the hot heat transfer fluid and a diluted desiccant and provides a concentrated desiccant and a humid, warm air stream. In one or more embodiments, the concentrated desiccant is flowing to a conditioner. In one or more embodiments, the conditioner is dehumidifying an air stream. In one or more embodiments, the conditioner is not receiving a heat transfer fluid and the dehumidification takes place adiabatically. In one or more embodiments, the conditioner is a 3-way liquid desiccant membrane conditioner. In one or more embodiments, the conditioner receives concentrated liquid desiccant from a regenerator. In one or more embodiments, the regenerator is a 3-way liquid desiccant membrane regenerator. In one or more embodiments, the conditioner is only receiving concentrated desiccant from the regenerator but no heat transfer fluid is flowing in the rainy season mode.

In accordance with one or more embodiments a liquid desiccant membrane system employs an evaporator, a geothermal loop wherein a heat transfer fluid is rejecting heat to a ground loop or geothermal loop, or a cooling tower to generate a cold heat transfer fluid wherein the cold heat transfer fluid is used to cool a liquid desiccant conditioner. In one or more embodiments, the water supplied to the evaporator is potable water. In one or more embodiments, the water is seawater. In one or more embodiments, the water is waste water. In one or more embodiments, the evaporator uses a membrane to prevent carry-over of non-desirable elements from the seawater or waste water to the air stream. In one or more embodiments, the water in the evaporator is not cycled back to the top of the indirect evaporator such as would happen in a cooling tower, but between 20% and 80% of the water is evaporated and the remainder is discarded. In one or more embodiments, the conditioner is a 3-way liquid desiccant membrane conditioner. In one or more embodiments, the conditioner receives concentrated liquid desiccant from a regenerator. In one or more embodiments, the regenerator is a 3-way liquid desiccant membrane regenerator. In one or more embodiments, the regenerator receives a hot heat transfer fluid from a heat source. In one or more embodiments, the heat source is a gas-fired water heater, a solar thermal or PVT (Photovoltaic and Thermal) panel, a combined heat and power system such as for example a fuel cell, a waste heat collection system or any convenient heat source. In one or more embodiments, the cool heat transfer fluid flows from the liquid desiccant conditioner to a heat exchanger and back to the evaporator where it is cooled again. In one or more embodiments, the heat exchanger only receives the cool heat transfer fluid but no flow occurs on the opposite side in a summer cooling and dehumidification mode. In accordance with one or more embodiments, the conditioned air stream is directed to an indirect evaporative cooler. In one or more embodiments, the indirect evaporative cooler is used to provide additional sensible cooling. This allows the system to provide cool, dehumidified air to a space in summer conditions. In accordance with one or more embodiments a liquid desiccant membrane system employs an evaporator or cooling tower to generate a cold heat transfer fluid in a summer cooling and dehumidification mode, but the evaporator is idled in a winter heating and humidification mode. In one or more embodiments, water, seawater or waste water is instead directed to a water injection module wherein the water, seawater or waste water flows on the one side and a concentrated desiccant flows on the opposite side. In one or more embodiments, the desiccant on the opposite side is diluted by the water, seawater or waste water. In one or more embodiments, the diluted desiccant is directed to a conditioner in a space. In one or more embodiments, the conditioner also receives a hot heat transfer fluid from a heat source. In one or more embodiments, the conditioner provides a warm, humid air stream to a space. In one or more embodiments, the conditioner is a 3-way liquid desiccant membrane conditioner. In one or more embodiments, the conditioner receives diluted liquid desiccant from a regenerator. In one or more embodiments, the regenerator is a 3-way liquid desiccant membrane regenerator. In one or more embodiments, the hot heat transfer fluid comes from a heat source. In one or more embodiments, the heat source is a gas-fired water heat, a solar panel, a combined heat and power system, a waste heat collection system or any convenient heat source.

In accordance with one or more embodiments a liquid desiccant membrane system employs an evaporator, a geothermal loop wherein a heat transfer fluid is rejecting heat to a ground loop or geothermal loop, or a cooling tower to generate a cold heat transfer fluid in a summer cooling and dehumidification mode, but the evaporator is idled in a winter heating and humidification mode as well as in a rainy season heating and dehumidification mode. In one or more embodiments, the liquid desiccant membrane system contains a regenerator generating a concentrated desiccant. In one or more embodiments, the concentrated desiccant is directed to a conditioner in a space. In one or more embodiments, the conditioner provides a warm, humid air stream to a space. In one or more embodiments, the conditioner is a 3-way liquid desiccant membrane conditioner. In one or more embodiments, the conditioner sends a diluted liquid desiccant back to the regenerator. In one or more embodiments, the regenerator is a 3-way liquid desiccant membrane regenerator. In one or more embodiments, the regenerator receives a hot heat transfer fluid from a heat source. In one or more embodiments, the heat source is a gas-fired water heat, a solar panel, a combined heat and power system, a waste heat collection system or any convenient heat source. In one or more embodiments, the hot heat transfer fluid from the heat source is also directed to a heat exchanger. In one or more embodiments, the heat exchanger provides heat to the opposite side where a second heat transfer fluid flows. In one or more embodiments, the second heat transfer fluid provides heat to the liquid desiccant conditioner in a space. In one or more embodiments, the conditioner receives both a concentrated desiccant and a warm heat transfer fluid in a rainy season heating and dehumidification mode.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION

Figure 1:
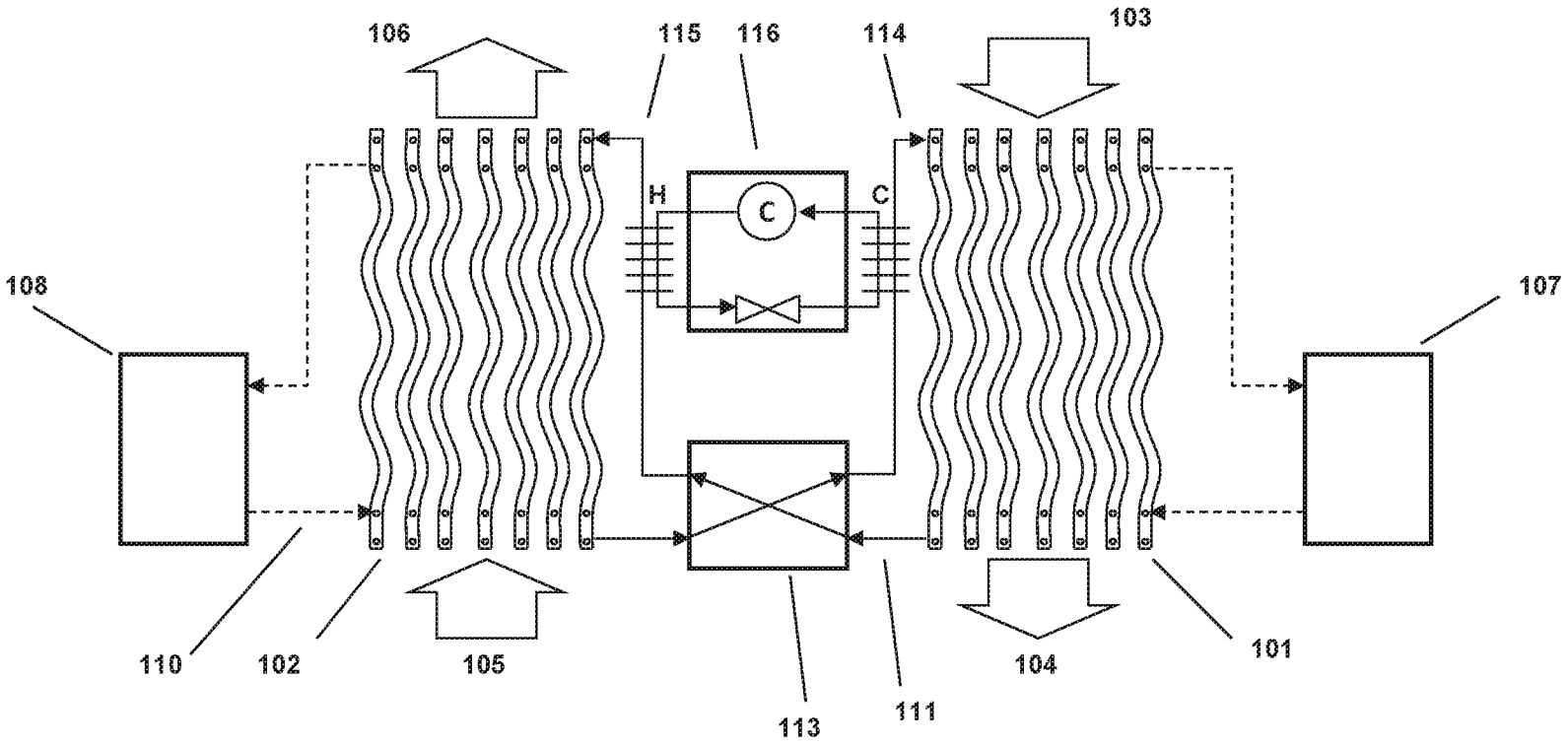
FIG. 1 illustrates an exemplary 3-way liquid desiccant air conditioning system using a chiller or external heating or cooling sources.

FIG. 1 depicts a new type of liquid desiccant system as described in more detail in U.S. Patent Application Publication No. US 20120125020, which is incorporated by reference herein. A conditioner 101 comprises a set of plate structures that are internally hollow. A cold heat transfer fluid is generated in cold source 107 and entered into the plates. Liquid desiccant solution at 114 is brought onto the outer surface of the plates and runs down the outer surface of each of the plates. The liquid desiccant runs behind a thin membrane that is located between the air flow and the surface of the plates. Outside air 103 is now blown through the set of (wavy) conditioner plates. The liquid desiccant on the surface of the plates attracts the water vapor in the air flow and the cooling water inside the plates helps to inhibit the air temperature from rising. The treated air 104 is put into a building space.

The liquid desiccant is collected at the bottom of the wavy conditioner plates at 111 and is transported through a heat exchanger 113 to the top of the regenerator 102 to point 115 where the liquid desiccant is distributed across the wavy plates of the regenerator. Return air or optionally outside air 105 is blown across the regenerator plate and water vapor is transported from the liquid desiccant into the leaving air stream 106. An optional heat source 108 provides the driving force for the regeneration. The hot transfer fluid 110 from the heat source can be put inside the wavy plates of the regenerator similar to the cold heat transfer fluid on the conditioner. Again, the liquid desiccant is collected at the bottom of the wavy plates 102 without the need for either a collection pan or bath so that also on the regenerator the air flow can be horizontal or vertical. An optional heat pump 116 can be used to provide cooling and heating of the liquid desiccant. It is also possible to connect a heat pump between the cold source 107 and the hot source 108, which is thus pumping heat from the cooling fluids rather than the desiccant.

Figure 2:
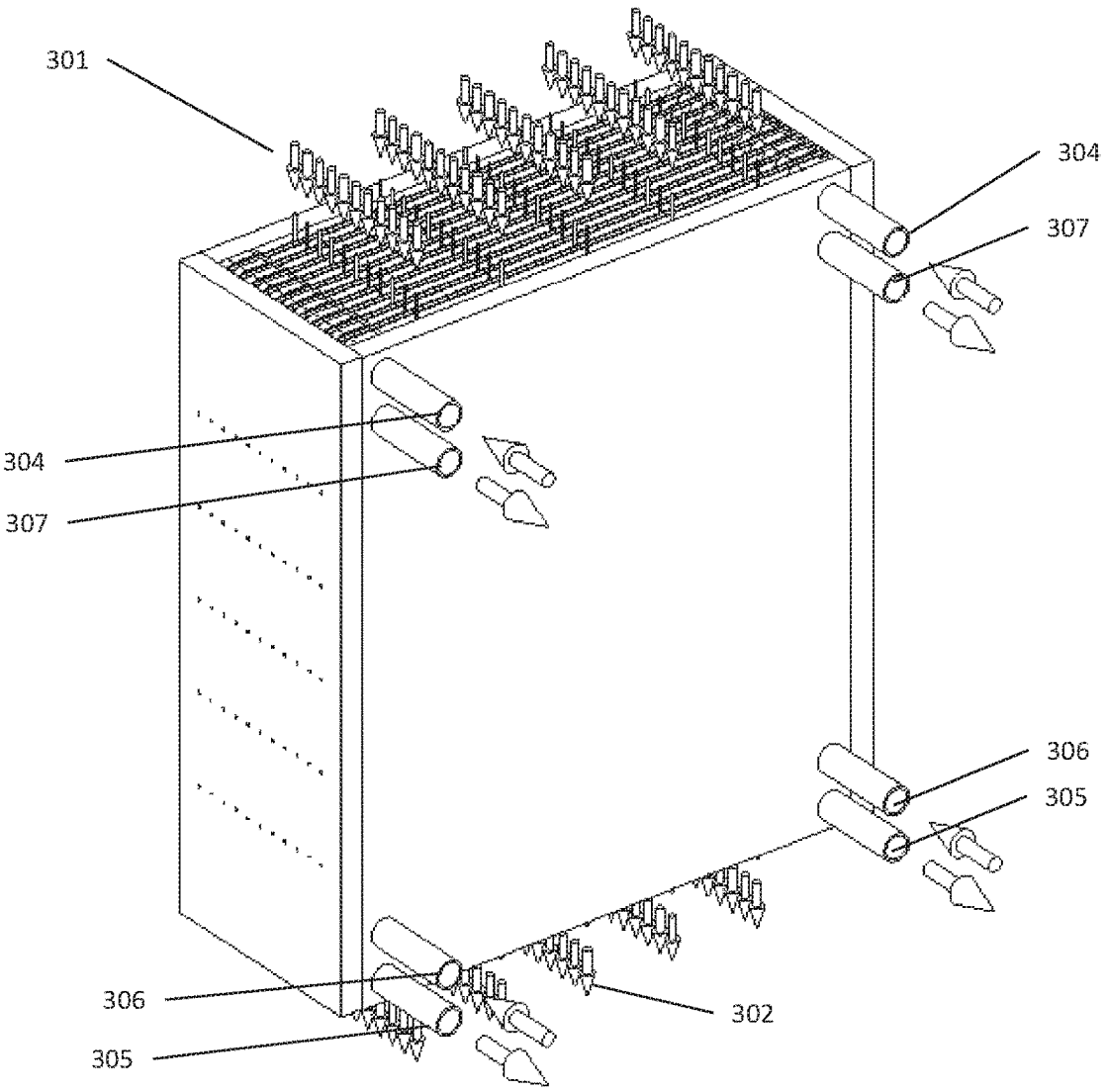
FIG. 2 shows an exemplary flexibly configurable membrane module that incorporates 3-way liquid desiccant plates.

FIG. 2 describes a 3-way heat exchanger as described in further detail in U.S. patent application Ser. No. 13/915,199 filed on Jun. 11, 2013, Ser. No. 13/915,222 filed on Jun. 11, 2013, and Ser. No. 13/915,262 filed on Jun. 11, 2013, which are all incorporated by reference herein. A liquid desiccant enters the structure through ports 304 and is directed behind a series of membranes as described in FIG. 1. The liquid desiccant is collected and removed through ports 305. A cooling or heating fluid is provided through ports 306 and runs counter to the air stream 301 inside the hollow plate structures, again as described in FIG. 1 and in more detail in FIG. 3. The cooling or heating fluids exit through ports 307. The treated air 302 is directed to a space in a building or is exhausted as the case may be. The figure illustrates a 3-way heat exchanger in which the air and heat transfer fluid are in a primarily vertical orientation. It is however also possible to flow the air and the heat transfer fluid in a horizontal aspect, which is not fundamental to the operation of the system.

Figure 3:
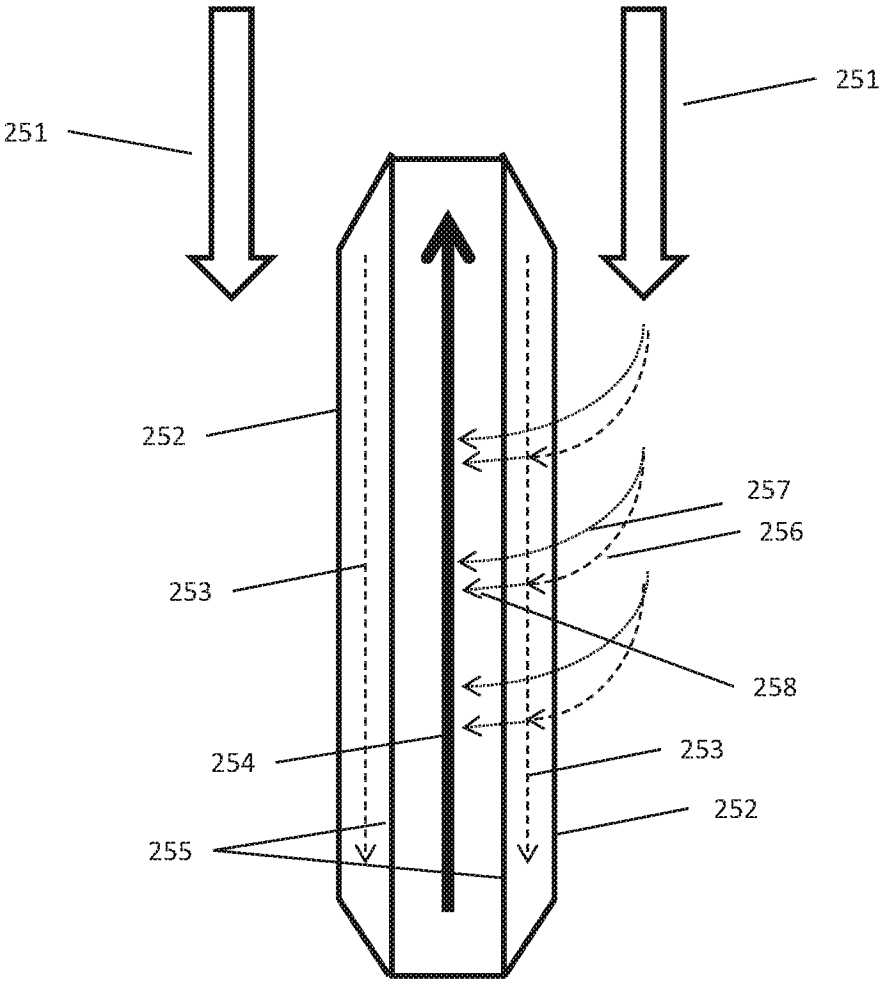
FIG. 3 illustrates an exemplary single membrane plate in the liquid desiccant membrane module of FIG. 2.

FIG. 3 describes a 3-way heat exchanger as described in more detail in U.S. Provisional Patent Applications Ser. No.

61/771,340 filed on Mar. 1, 2013, which is incorporated by reference herein. The air stream 251 flows counter to a cooling fluid stream 254. Membranes 252 contain a liquid desiccant 253 that is falling along the wall 255 that contain a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 4A:
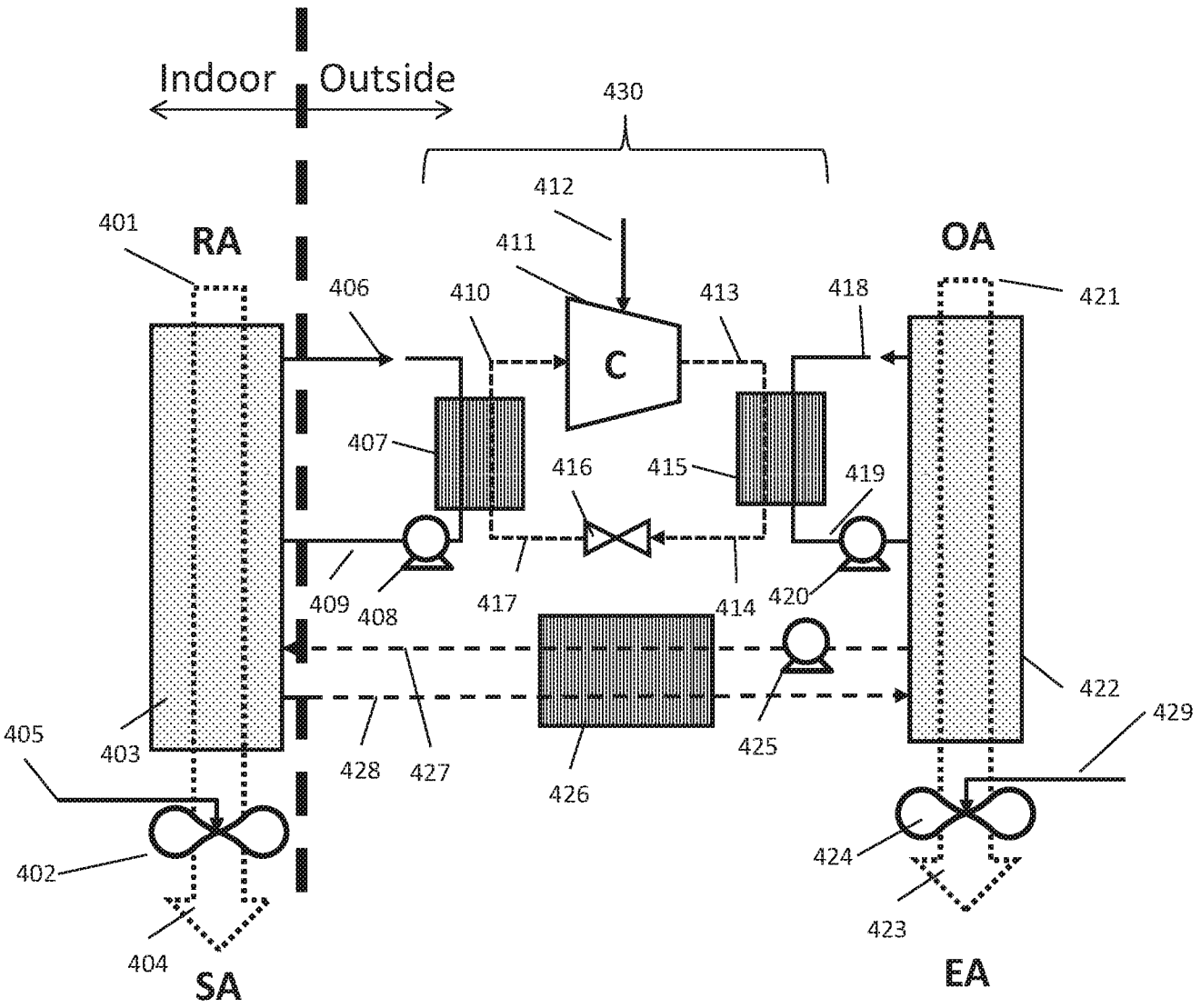
FIG. 4A illustrates a schematic of the system from FIG. 1 using outside air in a summer cooling and dehumidification mode.

FIG. 4A illustrates a schematic representation of a liquid desiccant air conditioner system as more fully described in application U.S. Patent Application Publication No. 20140260399, which is incorporated by reference herein. A 3-way conditioner 403 (which is similar to the conditioner 101 of FIG. 1) receives an air stream 401 from a room or from the outside ("RA"). Fan 402 powered by electricity 405 moves the air 401 through the conditioner 403 wherein the air is cooled and dehumidified in a summer cooling mode. The resulting cool, dry air 404 ("SA") is supplied to a space for occupant comfort. The 3-way conditioner 403 receives a concentrated desiccant 427 in the manner explained under FIGS. 1-3. It is preferable to use a membrane on the 3-way conditioner 403 to ensure that the desiccant is generally fully contained and is unable to get distributed into the air stream 404. The diluted desiccant 428, which now contains the captured water vapor is transported to the regenerator 422 which is generally located outdoor. Furthermore, chilled heat transfer fluid (usually water) 409 is provided by pump 408, and enters the conditioner module 403 where it picks up sensible heat from the air as well as latent heat released by the capture of water vapor in the desiccant. The warmer water 406 is also brought outside to the heat exchanger 407 which connects to the chiller system 430. It is worth noting that unlike the conventional mini-split system of FIGS. 5A and 5B which are described in the next section, the system of FIG. 4A and FIG. 4B has no high pressure lines between the indoor unit 403 and the outdoor unit, the lines between the indoor and outdoor system of FIG. 5A are all low pressure water and liquid desiccant lines. This allows the lines to be inexpensive plastics rather than refrigerant lines 509 and 526 in FIGS. 5A and 5B, which are typically copper and need to be braised in order to withstand the high refrigerant pressures which are usually between 50 and 400 PSI or higher. It is also worth noting that the system of FIG. 4A does not require a condensate drain line like line 507 in FIG. 5A. Rather, any moisture that is condensed into the desiccant is removed as part of the desiccant itself. This also eliminates problems with mold growth in standing water that can occur in the conventional mini-split systems of FIGS. 5A and 5B.

The liquid desiccant 428 leaves the conditioner 403 and is moved through the optional heat exchanger 426 to the regenerator 422 by pump 425. If the desiccant lines 427 and 428 are relatively long they can be thermally connected to each other, which eliminates the need for heat exchanger 426.

The chiller system 430 comprises a water to refrigerant evaporator heat exchanger 407 which cools the circulating cooling fluid 406. The liquid, cold refrigerant 417 evaporates in the heat exchanger 407 thereby absorbing the thermal energy from the cooling fluid 406. The gaseous refrigerant 410 is now re-compressed by compressor 411. The compressor 411 ejects hot refrigerant gas 413, which is liquefied in the condenser heat exchanger 415. The liquid refrigerant 414 then enters expansion valve 416, where it rapidly cools and exits at a lower pressure. It is worth noting that the chiller system 430 can be made very compact since the high pressure lines with refrigerant (410, 413, 414 and 417) only have to run very short distances. Furthermore, since the entire refrigerant system is located outside of the space that is to be conditioned, it is possible to utilize refrigerants that normally cannot be used in indoor environments such as by way of example, $CO_2$, Ammonia and Propane. These refrigerants are sometimes preferable over the commonly used R410A, R407A, R134A because of their lower greenhouse gas potential or over R1234YF and R1234ZE refrigerants, but they are undesirable indoor because of flammability or suffocation or inhalation risks. By keeping all of the refrigerants outside, these risks are significantly reduced. The condenser heat exchanger 415 now releases heat to another cooling fluid loop 419 which brings hot heat transfer fluid 418 to the regenerator 422. Circulating pump 420 brings the heat transfer fluid back to the condenser 415. The 3-way regenerator 422 thus receives a dilute liquid desiccant 428 and hot heat transfer fluid 418. A fan 424 powered by electricity 420 brings outside air 421 ("OA") through the regenerator 422. The outside air picks up heat and moisture from the heat transfer fluid 418 and desiccant 428 which results in hot humid exhaust air ("EA") 423.

The compressor 411 receives electrical power 412 and typically accounts for 80% of electrical power consumption of the system. The fan 402 and fan 424 also receive electrical power 405 and 429 respectively and account for most of the remaining power consumption. Pumps 408, 420 and 425 have relatively low power consumption. The compressor 411 will operate more efficiently than the compressor 510 in FIG. 5A for several reasons: the evaporator 407 in FIG. 4A will typically operate at higher temperature than the evaporator coil 501 in FIG. 5A because the liquid desiccant will condense water at much higher temperature without needing to reach saturation levels in the air stream. Furthermore the condenser 415 in FIG. 4A will operate at lower temperatures than the condenser coil 516 in FIG. 5A because of the evaporation occurring on the regenerator 422 which effectively keeps the condenser 415 cooler. As a result the system of FIG. 4A will use less electricity than the system of FIG. 5A for similar compressor isentropic efficiencies.

Figure 4B:
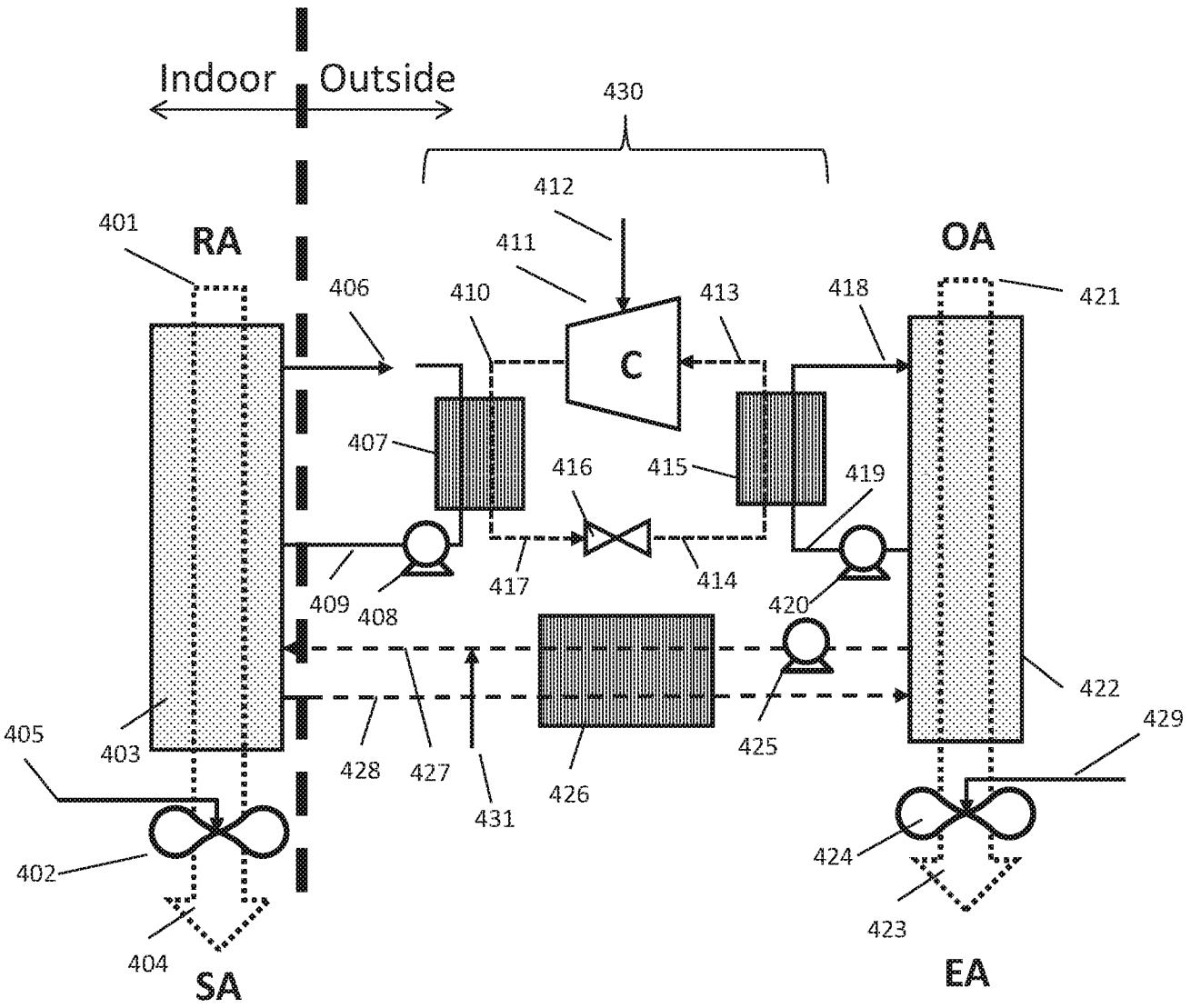
FIG. 4B illustrates a schematic of the system from FIG. 1 using outside air in a winter heating and humidification mode.
Figure 5A:
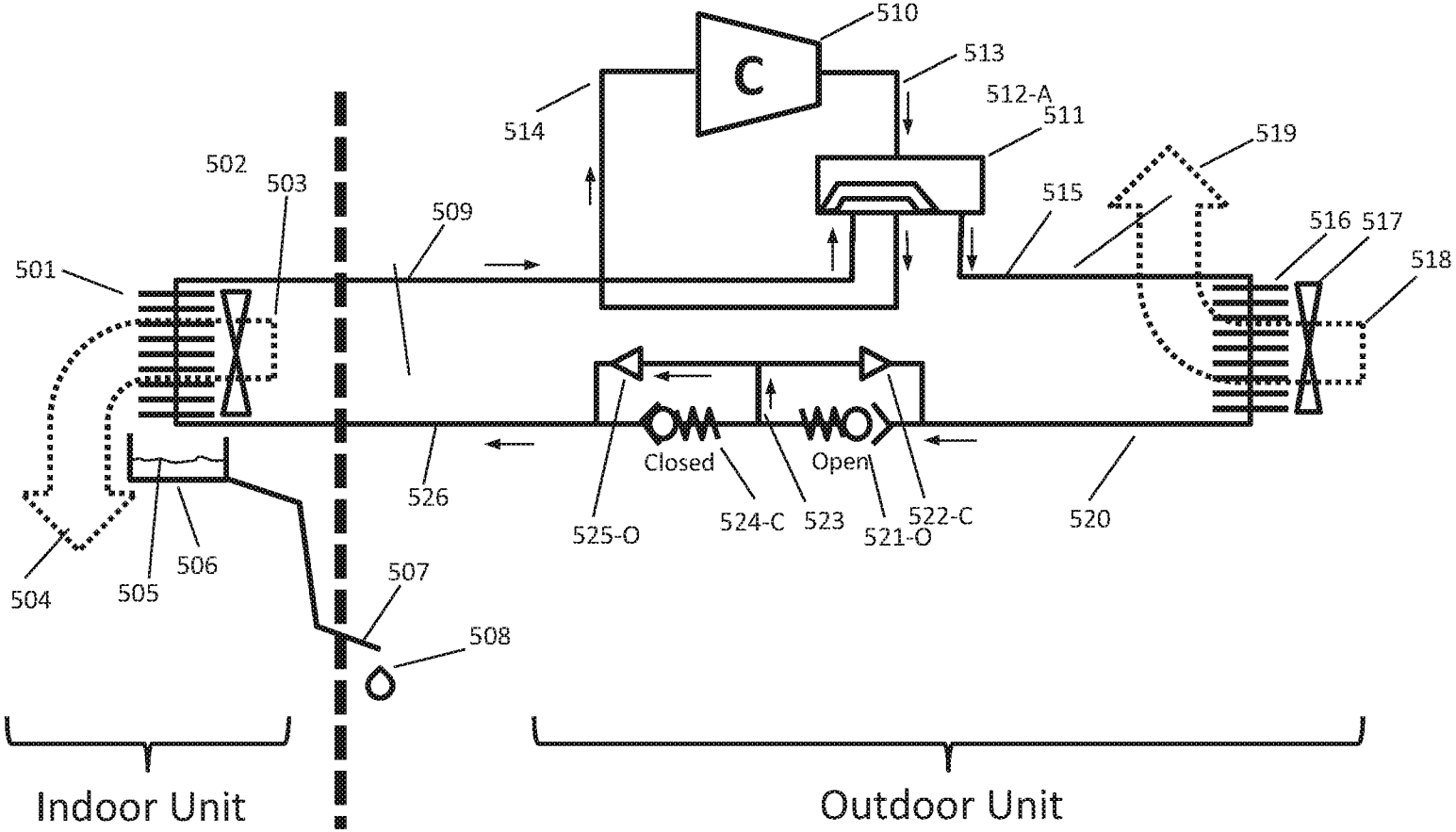
FIG. 5A shows a schematic of a conventional mini-split air conditioning system in a summer cooling and dehumidification mode.

FIG. 4B shows essentially the same system as FIG. 4A except that the compressor 411's refrigerant direction has been reversed as indicated by the arrows on refrigerant lines 414 and 410. Reversing the direction of refrigerant flow can be achieved by a 4-way reversing valve (shown in FIG. 5A and FIG. 5B) or other convenient means. It is also possible to instead of reversing the refrigerant flow to direct the hot heat transfer fluid 418 to the conditioner 403 and the cold heat transfer fluid 406 to the regenerator 422. This will in effect provide heat to the conditioner which will now create hot, humid air 404 for the space for operation in winter mode. In effect the system is now working as a heat pump, pumping heat from the outside air 423 to the space supply air 404. However unlike the system of FIGS. 5A and 5B, which is oftentimes also reversible, there is much less of a risk of the coil freezing because the desiccant 428 usually has much lower crystallization limit than water vapor so that the outdoor coil 516 in FIG. 5B will accumulate ice much more easily than the membrane plates in the regenerator 422. For example, in the system of FIG. 5B, the air stream 518 contains water vapor and if the condenser coil 516 gets too cold, this moisture will condense on the surfaces and create ice formation on those surfaces. The same moisture in the regenerator of FIG. 4B will condense in the liquid desiccant which, when managed properly and maintained at a concentration between 20 and 30%, will not crystalize until −60° C. for some desiccants such as solutions of LiCl and water.

FIG. 5A illustrates a schematic diagram of a conventional mini-split air conditioning system as is frequently installed in buildings operating in a summer cooling mode. The unit comprises a set of indoor components that generate cool, dehumidified air and a set of outdoor components that release heat to the environment. The indoor components comprise a cooling (evaporator) coil 501 through which a fan 502 blows air 503 from the room. The cooling coil cools the air and condenses water vapor on the coil which is collected in drain pan 506 and ducted to the outside 507. The resulting cooler, drier air 504 is circulated into the space and provides occupant comfort. The cooling coil 501 receives liquid refrigerant at pressure of typically 50-200 psi through line 526, which has already been expanded to a low temperature and pressure by open expansion valve 525-O. The pressure of the refrigerant in line 523 before the expansion valve 525-O is typically 300-600 psi. The cold liquid refrigerant 526 enters the cooling coil 501 where it picks up heat from the air stream 503. The heat from the air stream evaporates the liquid refrigerant in the coil and the resulting gas is transported through line 509 to the outdoor components and more specifically to the compressor 510 where it is re-compressed to a high pressure of typically 300-600 psi. In some instances the system can have multiple cooling coils 501, fans 502 and expansion valves 525-O, for example a number of individual cooling coil assemblies could be located in various rooms that need to be cooled.

Besides the compressor 510, the outdoor components comprise a condenser coil 516 and a condenser fan 517 as well as a four-way valve assembly 511. The four-way valve 512 (which for convenience has been labeled the 512-"A" position) has been positioned inside the valve body 511 so that the hot refrigerant 513 is directed to the condenser coil 516 through line 515. The fan 517 blows outside air 518 through the condenser coil 516 where it picks up heat from the compressor 510 which is rejected to the air stream 519. The cooled liquid refrigerant 520 is conducted to a set of valves 521, 522, 524 and 525, with the addition of an "O" for open or a "C" for closed. As can be seen in the figure, the refrigerant 520 goes through the check valve 521-O and bypasses the expansion valve 522-C. Since the second check valve 524-C is closed, the refrigerant moves through line 523 and to the second expansion valve 525-O in which the refrigerant expands and cools. The cold refrigerant 526 is then conducted to the evaporator 501 where it picks up heat and expands back to a gas. The gas 509 is then conducted to the 4-way valve 511 and flows back to the compressor 510 through line 514.

In some instances the system can have multiple compressors or multiple condenser coils and fans. The primary electrical energy consuming components are the compressor 510, the condenser fan 516 and the evaporator fan 502. In general the compressor uses close to 80% of the electricity required to operate the system, with the condenser and evaporator fans taking about 10% of the electricity each.

Figure 5B:
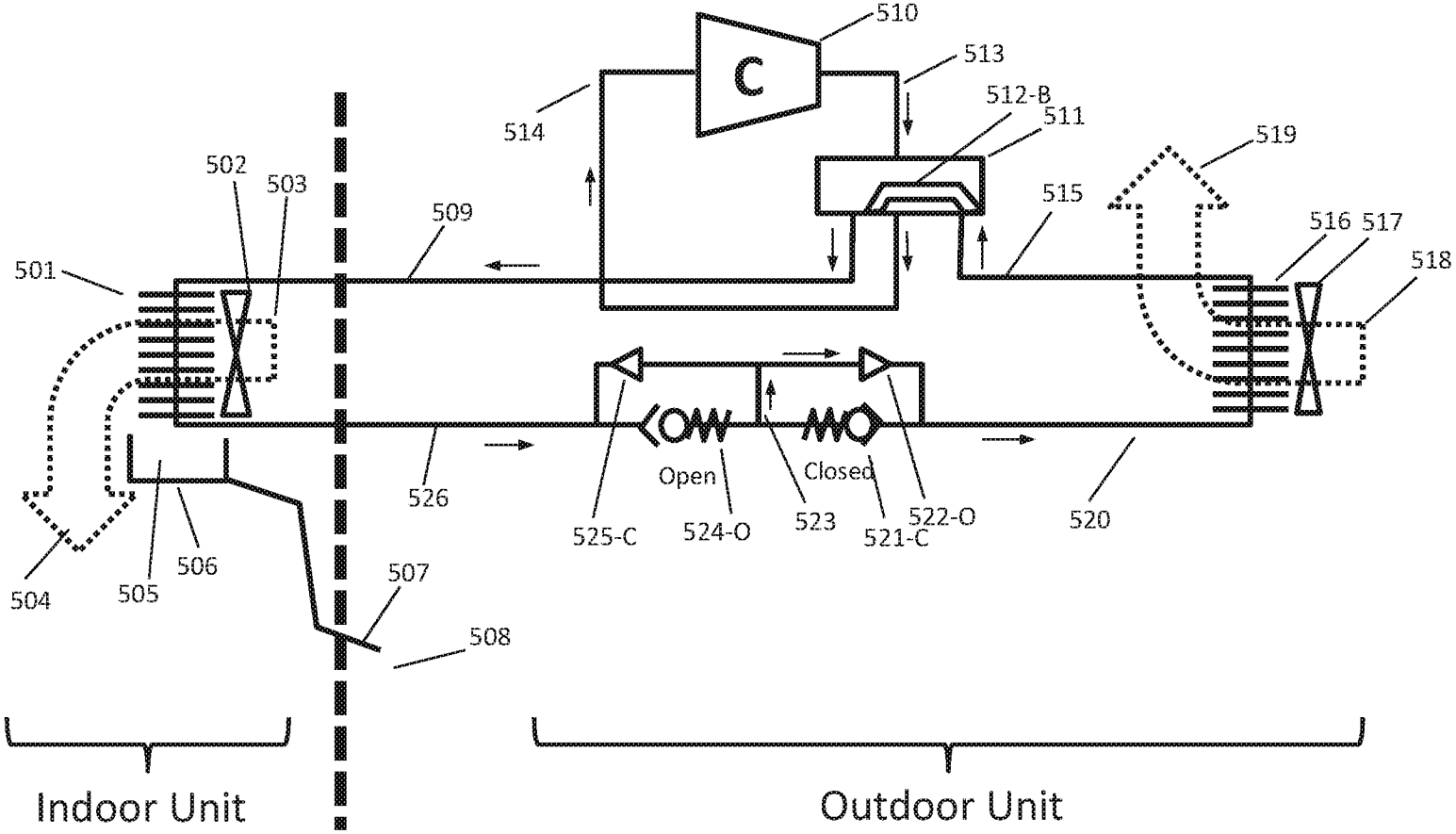
FIG. 5B shows a schematic of a conventional mini-split air conditioning system in a winter heating mode.

FIG. 5B illustrates a conventional mini-split system operating in winter heating mode. The main difference with FIG. 5A is that the valve 512 in the 4-way valve body 511 has been moved to the "B" position. This directs the hot refrigerant to the indoor evaporator coil which becomes in effect the condenser coil. The valves 521, 522, 524 and 525 also switch position and the refrigerant now flows through check valve 524-O and expansion valve 522-O while expansion valve 525-C and check valve 521-C are closed. The refrigerant then picks up heat from the outside air 518 before being returned through valve body 511 and valve 512-B to the compressor 510. There are two noteworthy items to this conventional mini-split heat pump: first the outside air is cooled, which can lead to freezing of moisture on the outside coil 516, leading to ice formation. This can be counteracted as is oftentimes done, by simply running the system in cooling mode for a short while so that the ice can fall off the coil. However, that of course is not very energy efficient and leads to poor energy performance. Furthermore, there still is a limit and at low enough temperatures, even reversing the system will not be adequate and other heating means may need to be provided. Second, the indoor unit will only provide sensible heat, which can lead to overly dry spaces in the wintertime. This can of course be counteracted by having a humidifier in the space, but such a humidifier will also lead to additional heating costs.

Figure 6A:
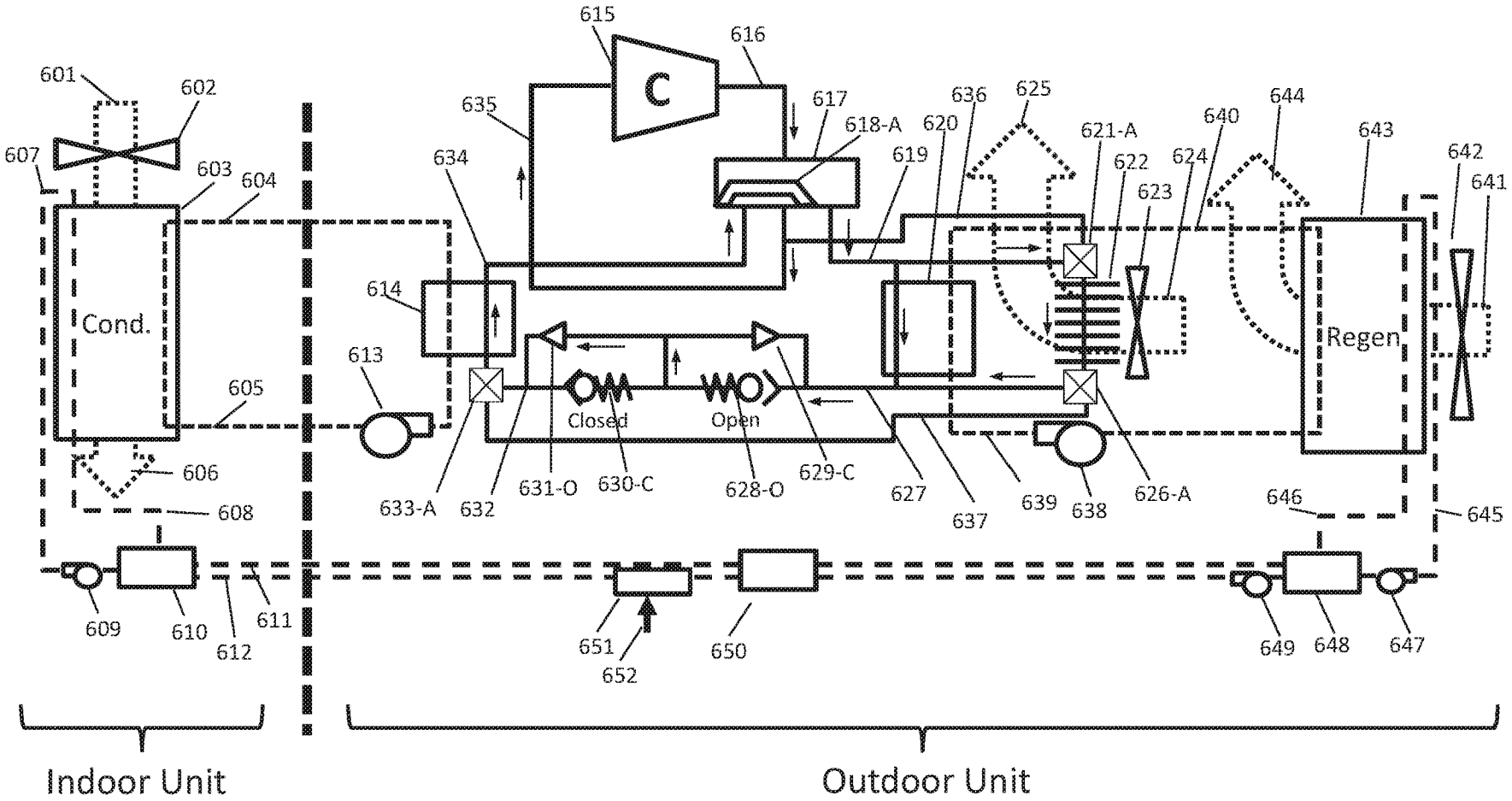
FIG. 6A shows a schematic of an exemplary chiller assisted mini-split liquid desiccant air conditioning system in a summer cooling and dehumidification mode in accordance with one or more embodiments using one 4-way and three 3-way refrigerant valves.

FIG. 6A illustrates an alternate embodiment of a mini-split liquid desiccant system set up in a summer cooling and dehumidification mode. Similar to FIG. 4A, a 3-way liquid desiccant conditioner 603 receives an air stream 601 which is moved by fan 602 through the conditioner 603. The treated air 606 is directed into the space. The conditioner 603 receives concentrated liquid desiccant 607 which, as explained in FIG. 2 and FIG. 3, picks up moisture from the air stream 601. The diluted liquid desiccant 608 can now be directed to a small reservoir 610. Pump 609 brings concentrated desiccant 607 from the reservoir 610 back to the conditioner 603. Dilute desiccant 611 is moved to reservoir 648 where it can be directed to the regenerator 643. Concentrated desiccant 612 from the regenerator 643 is added to the reservoir 610. At the same time the conditioner 603 receives a heat transfer fluid 604 which can be either cold or hot. The heat transfer fluid leaves the conditioner 603 at line 605 and is circulated by pump 613 through fluid to refrigerant heat exchanger 614 where the fluid is either cooled or heated. The exact setup of pumps 609 and 613 and of reservoir 610 is not fundamental to the description of this system and can be varied based on the exact application and installation.

Refrigerant compressor 615 compresses a refrigerant gas to high pressure and the resulting hot refrigerant 616 is directed to a 4-way valve assembly 617. The valve 618 is in the "A" position as before labeled 618-A in the figure. In this position the hot refrigerant gas is directed through line 619 to two heat exchangers: a refrigerant to liquid heat exchanger 620, and a refrigerant to air heat exchanger 622 through 3-way switching valve 621-A also in the "A" position which directs the refrigerant to the heat exchanger 622. The refrigerant leaves the heat exchanger 622 through 3-way switching valve 626-A which is also in an "A" position, which directs the refrigerant through line 627. The refrigerant from heat exchanger 620 is combined and both streams flow to a set of valves 628, 629, 630 and 631. The check valve 628-O is open and allows the refrigerant to flow to expansion valve 631-O which expands the liquid refrigerant to become cold in line 632. Check valve 630-C is closed as is expansion valve 629-C. The refrigerant next encounters another 3-way switching valve 633-A in the "A" position. The cold refrigerant now picks up heat in the aforementioned heat exchanger 614. The warmer refrigerant then moves through line 634 to the 4-way valve 617, where it is directed back to the compressor 615 through line 635. The liquid to refrigerant heat exchanger 620 is supplied with a heat transfer fluid (usually water) through line 639 by pump 638. The heated heat transfer fluid is then directed through line 640 to a regenerator membrane module 643, which is similar in construction as the module from FIG. 2. The regenerator module 643 receives an air stream 641 through fan 642. The air stream 641 is now heated by the heat transfer fluid and picks up moisture from the diluted liquid desiccant 645 which results in a hot, moist exhaust air stream 644. Pump 647 moves the diluted liquid desiccant from reservoir 648 to the membrane module 643 and re-concentrated liquid desiccant 646 is moved back to the reservoir 648. A small pump 649 can provide desiccant flow between the reservoirs 610 and 648. At the same time, an air stream 624 is directed by fan 623 through the air to refrigerant heat exchanger 622. The air stream 624 is sensibly heated by the refrigerant and the resulting hot air 625 constitutes a second exhaust stream. Refrigerant line 637 is inactive in this summer cooling mode and its use will be described under FIG. 6C. It is also possible to thermally connect desiccant lines 611 and 612 and form a heat exchanger between the two lines so that heat from the regenerator 643 is not conducted directly to the conditioner 603, which will reduce the energy load on the conditioner. Furthermore it is possible to add a separate liquid desiccant to liquid desiccant heat exchanger 650 instead of thermally connecting lines 611 and 612. An optional water injection system 651 (which is further described in U.S. patent application Ser. No. 14/664,219 incorporated by reference herein) prevents overconcentration of the desiccant in certain conditions by adding water 652 to the desiccant, which also can have the effect of making the system more energy efficient.

Figure 6B:
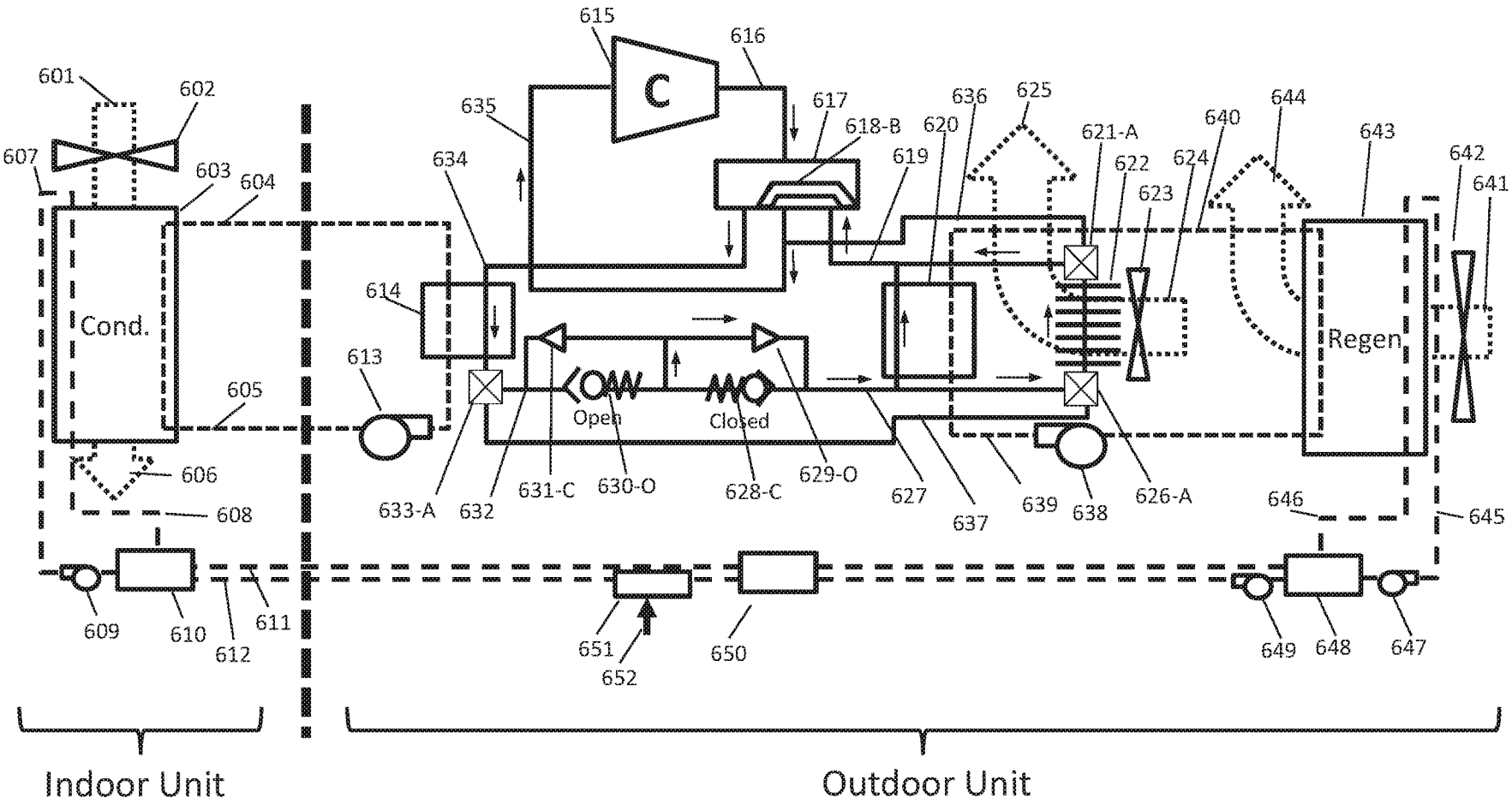
FIG. 6B shows a schematic of an exemplary chiller assisted mini-split liquid desiccant air conditioning system in a winter heating and humidification mode in accordance with one or more embodiments using one 4-way and three 3-way refrigerant valves.

In FIG. 6B, the system of FIG. 6A has been switched to a winter heating and humidification mode. The valve 618 has been switched from the "A" to the "B" position, which results in reversal of the refrigerant flow through the circuits in such a way that heat exchanger 614 now receives hot refrigerant whereas heat exchangers 622 and 620 receive cold refrigerant. Valve 628-C is now closed, expansion valve 629-O is open, valve 630-O is open and expansion valve 631-C is closed. In this mode the refrigerant system is pulling heat from air streams 641 and 624 and directing it to the conditioner 603 which is now providing heated, moist air to the space. The liquid desiccant is delivering moisture to the space and thus is getting more concentrated in the conditioner 603. The liquid desiccant is pulling moisture from the air stream 641. However, there are limits to this: if the air stream 641 is relatively dry, there may not be enough moisture available and the desiccant could become over-concentrated. U.S. Patent Application No. 61/968,333 filed Mar. 20, 2014, which is incorporated by reference herein, describes a method to add water to the liquid desiccant to prevent this from happening as will be shown in FIG. 9B. This method could also be applied here and water could be injected for example in line 611. Furthermore, the air stream 624 may at some temperatures get overly cold and ice could start forming on heat exchanger 622. In such a situation it would be possible to shut down the fan 623 and instead have all heat and moisture be taken out by regenerator 643.

Figure 6C:
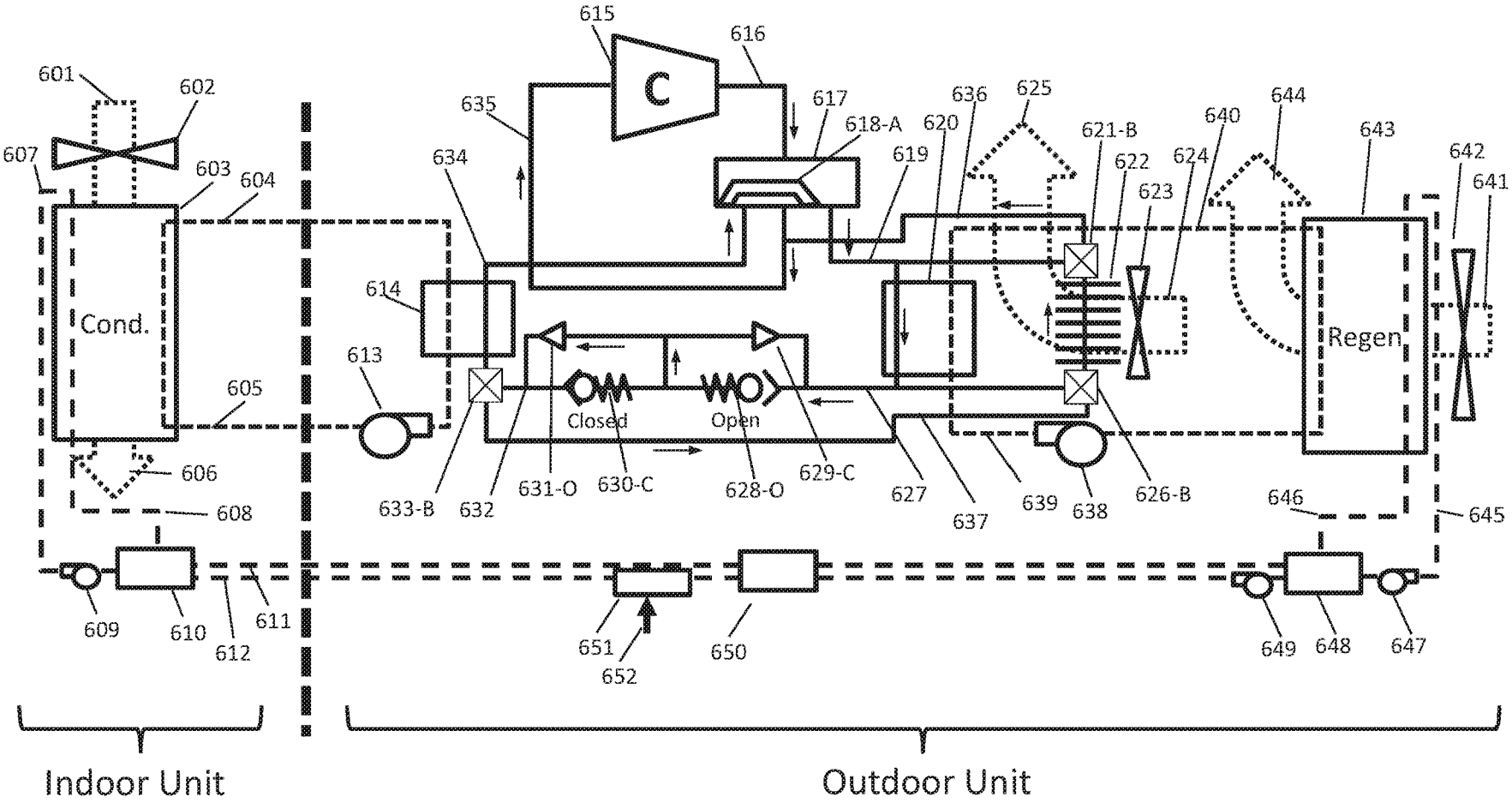
FIG. 6C shows a schematic of an exemplary chiller assisted mini-split liquid desiccant air conditioning system in a shoulder season heating and dehumidification mode in accordance with one or more embodiments using one 4-way and three 3-way refrigerant valves.

FIG. 6C shows the same system of FIG. 6A and 6B, with the difference that in this special operating mode the indoor conditioner unit is 603 is set up so that it provides heating and dehumidification of the air stream. This operating mode is particularly useful in seasons where the outside air is cold and the humidity is high such as the rainy season known in Asia as the plum-rain season. This mode is achieved by switching the valve 618 into the "A" position, and switching the 3-way refrigerant valves 621, 626 and 633 from the "A" to the "B" position. The hot refrigerant now takes a different path: after exiting valve 618-A it is directed through line 619, and heat exchanger 620. However, because valve 621-B is in the "B" position, no hot refrigerant will flow through heat exchanger 622. Instead the refrigerant flows through valves 628-O and expansion valve 631-O where it is cooled. Valve 633-B is now in the "B" position and directs the cold refrigerant to line 637 where it reaches valve 626-B also now in the "B" position. The cold refrigerant thus enters the heat exchanger 622 where it is able to pick up heat from air stream 624. Valve 621-B which is also in the "B" position, now directs the warmer refrigerant gas leaving the heat exchanger 622 to line 619 and 635 where it returns to the compressor 615. This configuration effectively pumps heat through the refrigerant system from heat exchanger 622 to heat exchanger 620, thereby producing hot heat transfer fluid through line 639 which thus allows the regenerator 643 to receive hot heat transfer fluid and produce more concentrated desiccant 646. Since the heat exchanger 614 is not receiving any refrigerant and is in effect inactive, pump 613 can be shut down and the conditioner module 603 no longer receives any heat transfer fluid. As a result the air stream 601 is now exposed to the concentrated desiccant 607 but because of the lack of heat transfer fluid flow through line 605, the air will dehumidify adiabatically and warm, dry air 606 will exit the conditioner. It should be clear that other circuiting options for the refrigerant can achieve the same effect or potentially provide hot refrigerant to heat exchanger 614 which will then provide additional heating capacity. The conditioner 603 thus heats and dehumidifies the air stream 601. The diluted desiccant is now regenerated by regenerator 643 which is still receiving heat from the compressor 615 which in effect pumps it from the outside air 624.

Figure 7A:
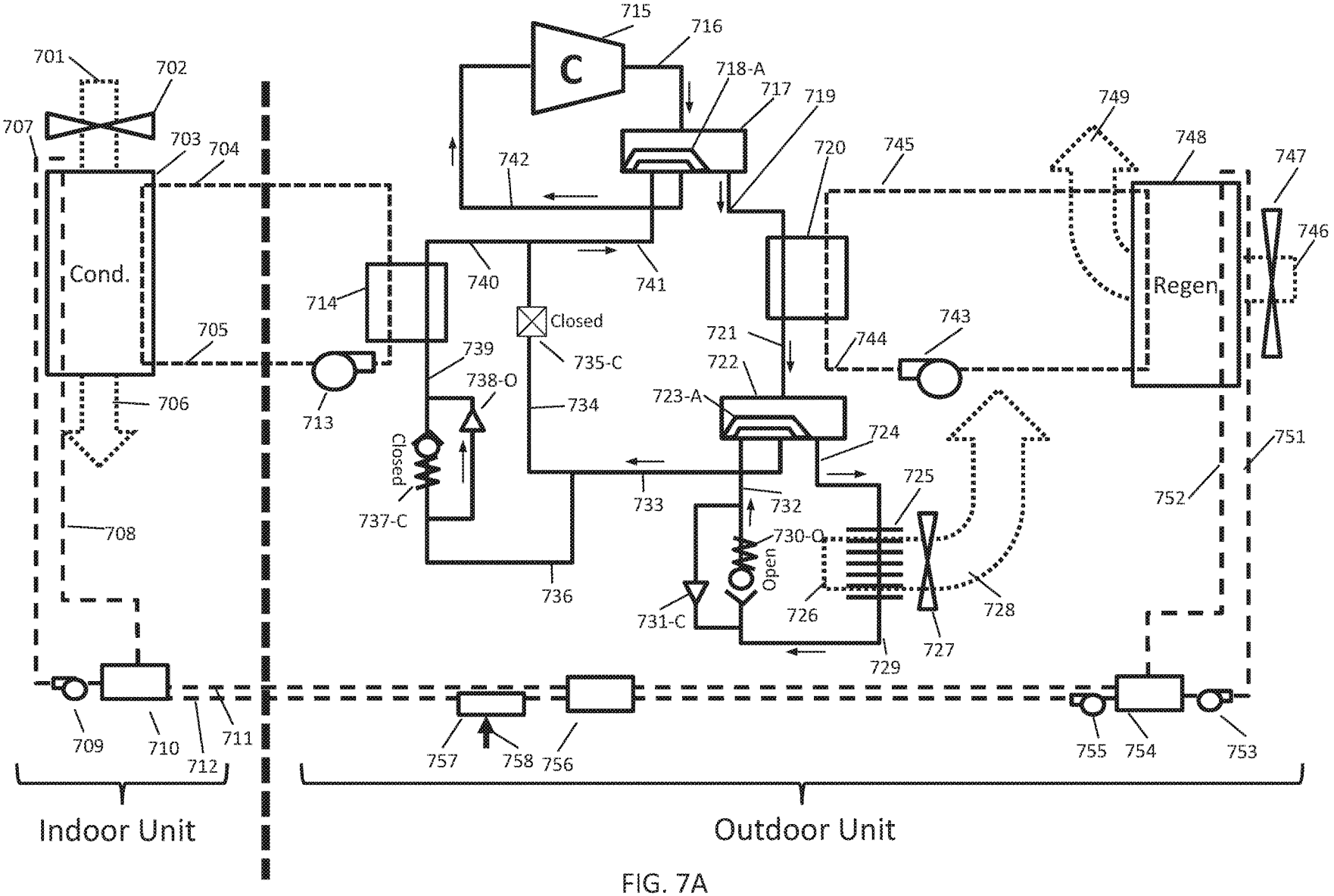
FIG. 7A shows a schematic of an exemplary chiller assisted mini-split liquid desiccant air conditioning system in a summer cooling and dehumidification mode in accordance with one or more embodiments using two 4-way and one shutoff refrigerant valves.

FIG. 7A illustrates a different embodiment of a mini-split liquid desiccant system set up in a summer cooling and dehumidification mode. Similar to FIG. 6A, a 3-way liquid desiccant conditioner 703 receives an air stream 701 which is moved by fan 702 through the conditioner 703. The treated air 706 is directed into the space. The conditioner 703 receives concentrated liquid desiccant 707 which, as explained in FIG. 2 and FIG. 3, picks up moisture from the air stream 701. The diluted liquid desiccant 708 can now be directed to a small reservoir 710. Pump 709 brings concentrated desiccant 707 from the reservoir 710 back to the conditioner 703. Dilute desiccant in line 711 is moved to reservoir 754 where it can be directed to the regenerator 748. Concentrated desiccant in line 712 from the regenerator 748 is added to the reservoir 710 by pump 755. At the same time the conditioner 703 receives a heat transfer fluid 704 which can be either cold or hot. The heat transfer fluid leaves the conditioner 703 at line 705 and is circulated by pump 713 through fluid to refrigerant heat exchanger 714 where the fluid is either cooled or heated. The exact setup of pumps 709, 713 and 755 and of reservoir 710 and 754 is not fundamental to the description of this system and can be varied based on the exact application and installation. It is also possible to thermally connect desiccant lines 711 and 712 and form a heat exchanger between the two lines so that heat from the regenerator 748 is not conducted directly to the conditioner 703, which will reduce the energy load on the conditioner. Furthermore it is possible to add a separate liquid desiccant to liquid desiccant heat exchanger 756 instead of thermally connecting lines 711 and 712. An optional water injection system 757 (which is further described in U.S. patent application Ser. No. 14/664,219 incorporated by reference herein) prevents overconcentration of the desiccant in certain conditions by adding water 758 to the desiccant, which also can have the effect of making the system more energy efficient.

Refrigerant compressor 715 compresses a refrigerant gas to high pressure and the resulting hot refrigerant 716 is directed to a 4-way valve assembly 717. The valve 718 is in the "A" position as before, and is labeled 718-A in the figure. In this position the hot refrigerant gas is directed through line 719 to a refrigerant-to-liquid heat exchanger 720. The refrigerant leaves the heat exchanger 720 and is directed through line 721 to a second 4-way valve assembly 722 with the valve 723-A in an "A" position, which directs the refrigerant through line 724 and subsequently to condenser coil 725. Condenser coil 725 receives an air stream 726 moved by fan 727 resulting in a heated exhaust air stream 728. The cooler refrigerant leaves the coil 725 through line 729 and is directed to the open valve 730-O. Expansion valve 731-C is closed and inactive in this operating mode. The refrigerant moves back to 4-way valve 722 through line 732 and is directed through line 733 and line 736 to expansion valve 738-O which expands the refrigerant. Check valve 737-C is closed and inactive. The cold refrigerant enters the heat exchanger 714 through line 739 and removes heat from the heat transfer fluid on the opposite side of the heat exchanger 714. The warmer refrigerant is then moved through line 740 and 741 to 4-way valve 717 where it is directed through line 742 back to the compressor 715. Line 734 and valve 735-C are inactive or closed respectively.

The refrigerant to liquid heat exchanger 720, receives a heat transfer fluid (usually water or a water/glycol mixture but generally any heat transfer fluid will do) pumped by pump 743 through line 744. The heat from the compressed refrigerant in line 719 is transferred in the heat exchanger 720 to the heat transfer fluid and the hot heat transfer fluid is directed through line 745 to a set of regenerator plates 748 similarly constructed to those as described in FIG. 2 and FIG. 3. The hot heat transfer fluid drives moisture out of the weak desiccant that is directed to the regenerator 748 by pump 753 through weak desiccant supply line 751. Air 746 is blown by fan 747 through the regenerator module 748 and results in hot, humid air 749 being exhausted from the system. The concentrated desiccant exiting the regenerator 748 is directed through line 752 to an optional collection tank 754. From there the concentrated desiccant makes its way back through the indoor conditioner 703 where it again picks up moistures.

The system of FIG. 7A is able to provide sensible cooling and dehumidification at a much higher temperature as a conventional mini-split system. As a result, the indoor room will feel drier and more comfortable than what a conventional system will be able to deliver and the system will do this with less lift (the difference in temperature of refrigerant across the compressor 715) as a conventional system would have.

Figure 7B:
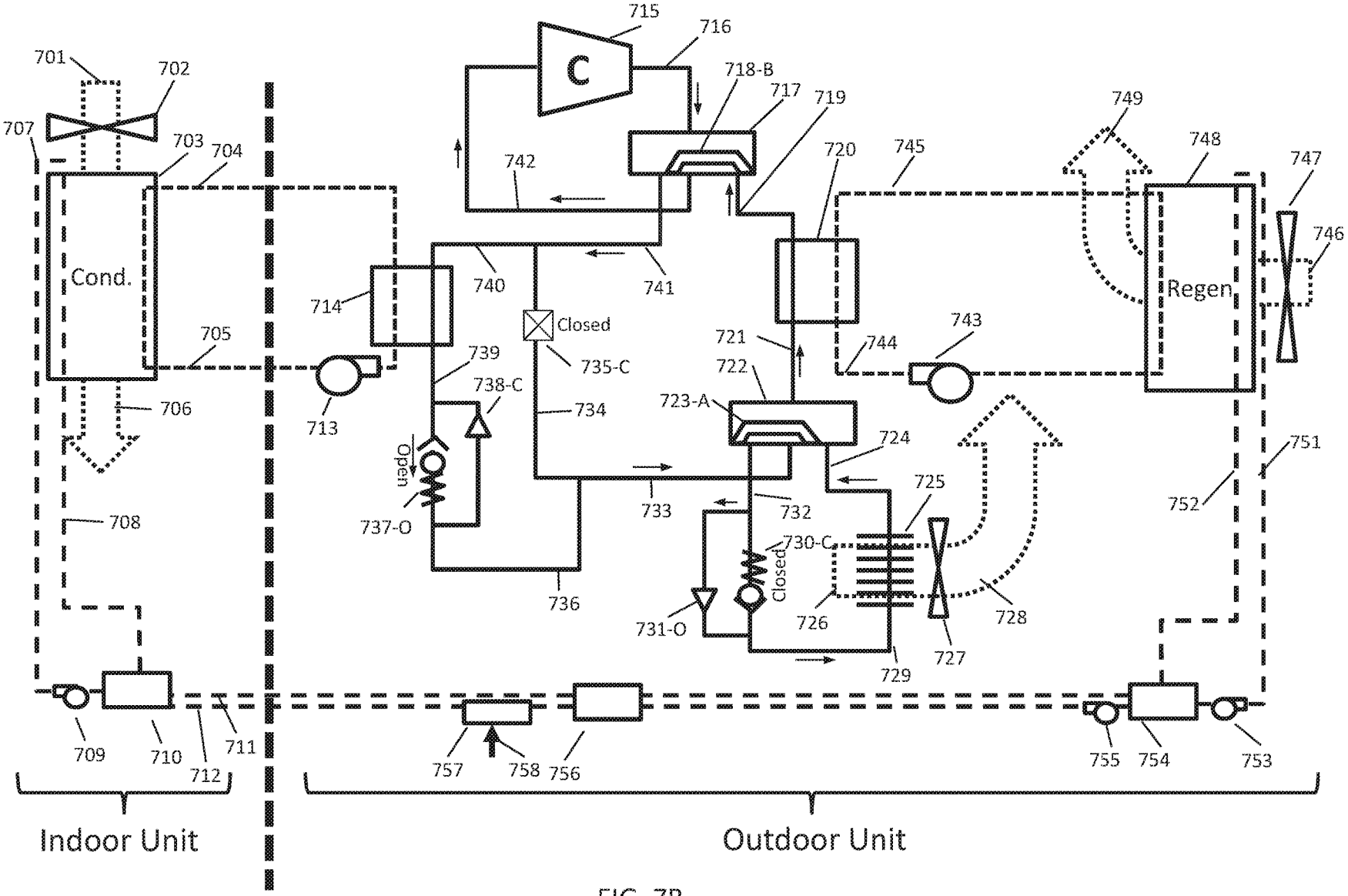
FIG. 7B shows a schematic of an exemplary chiller assisted mini-split liquid desiccant air conditioning system in a winter heating and humidification mode in accordance with one or more embodiments using two 4-way and one shutoff refrigerant valves.

FIG. 7B shows the system of FIG. 7A in a winter heating and humidification mode. Valve 718 has been placed in the "B" position resulting in a different direction of the refrigerant flow: the hot refrigerant leaving the compressor 715 through line 716 is now directed through line 741 to heat exchanger 714. This results in the conditioner 703 receiving hot heat transfer fluid through line 704 and as a result the air 701 going through the conditioner 703 is getting heated and humidified resulting in a warm, moist air stream 706 into the space. The cooler refrigerant is now directed through line 739, 736 and 733 to valve 722 which is still in the "A" position as before. The refrigerant is expanded and cooled in expansion valve 731-O and the cold refrigerant is directed to coil 725, back through valve 722 and to heat exchanger 720 before returning through lines 721, valve 717 and line 742 to the compressor 715. The advantage of this setup is that the system now provides moist, warm air to the space which will prevent the space from becoming too dry as is the case with conventional mini-split heat pump air conditioners. This will add to user comfort since conventional air conditioning heat pumps only provide heat unless a separate humidifier is used. The other advantage of this system is that in winter the heat can be primarily pumped from the regenerator module 748. Since this module only has desiccant and heat transfer fluid, it will be able to operate at much lower temperatures than the condenser coil of a conventional heat pump system, which starts to have ice formation when the outside air temperatures reaches 32F and the relative humidity is near 100%. Conventional heat pumps in that case will temporarily reverse cycle so that ice can be removed from the coil, meaning that they are cooling the space for a little while in reverse cycle mode. This obviously is not very energy efficient. The system of FIG. 7B will not have to reverse cycle if the liquid desiccant concentration is kept at concentrations of approximately 20-30%. This is possible in general as long as there is enough moisture in the outside air. At very low humidity levels (below 20% relative humidity or under 2 g/kg of moisture) there may be a need to continue to add water to the desiccant so that indoor humidity can be maintained. It is also possible to add water to the liquid desiccant which is described, for example, in U.S. Patent Application No. 61/968,333, which is incorporated by reference herein.

Figure 7C:
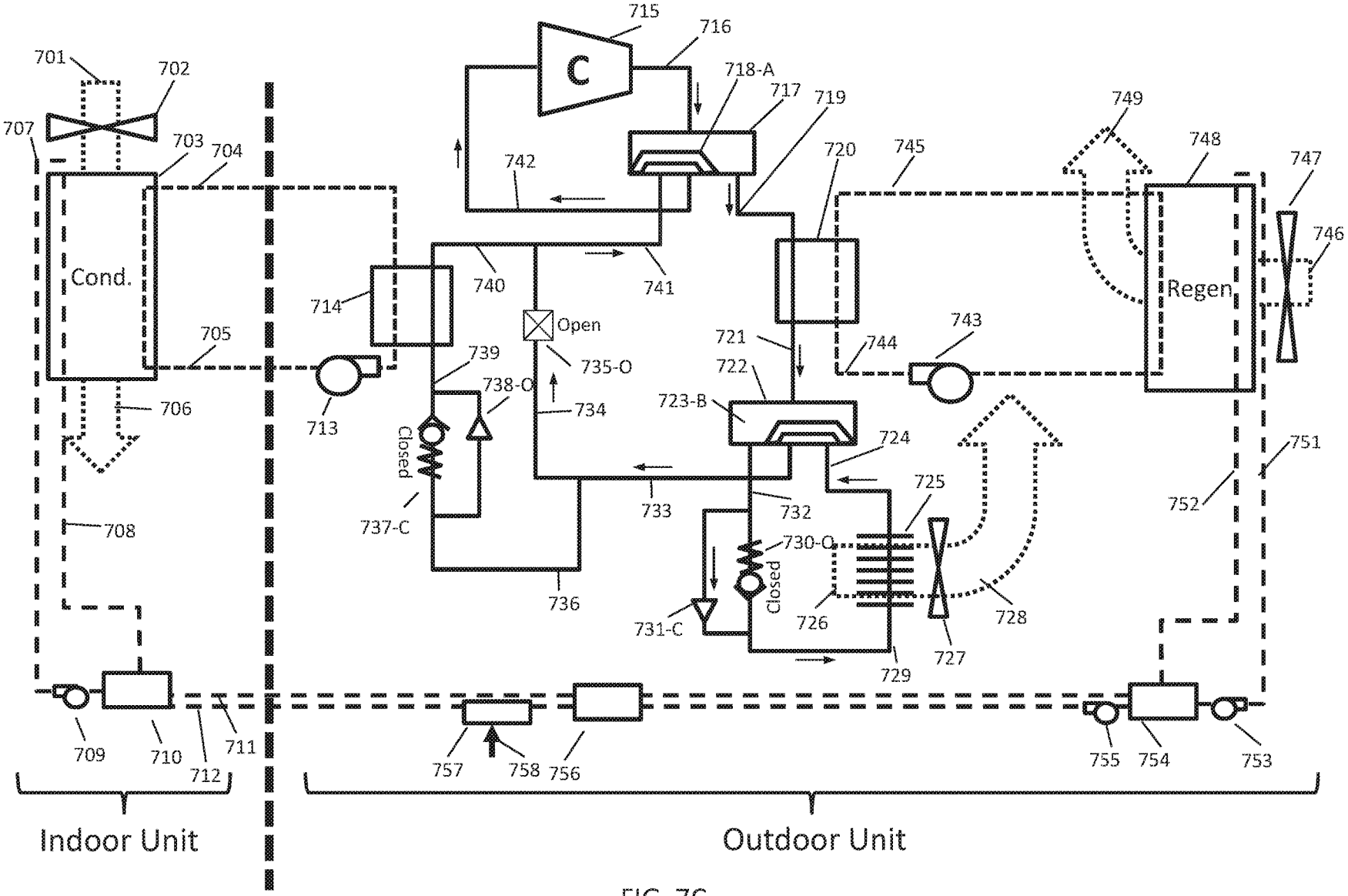
FIG. 7C shows a schematic of an exemplary chiller assisted mini-split liquid desiccant air conditioning system in a shoulder season heating and dehumidification mode in accordance with one or more embodiments using two 4-way and one shutoff refrigerant valves.

FIG. 7C illustrates in a similar way as FIG. 6C a special mode that allows for the indoor space to be heated as well as dehumidified. This would occur when outdoor conditions are cold and very humid, as is for example the case on rainy early spring days. In mainland China this is known as the plum rain season and conditions during that time of year result in very humid and cold indoor conditions, leading to mold problems and health issues. In this mode the system is set up as in FIG. 7A, but with the second 4-way valve 722 in the "B" position and bypass valve 735 in the open position indicated as 735-O in the figure. The hot refrigerant from the compressor 715 is directed through line 716, valve 717 and line 719 to heat exchanger 720 where heat is removed into the circulating heat transfer fluid loop 744, 745. The condensed refrigerant is then directed through line 721 into valve 722 which has been set in the "B" position, which directs the refrigerant to expansion valve 731-C in which it is expanded and cooled. The fan 727 now moves air through coil 725 which allows the refrigerant to pick up heat and the evaporated refrigerant is directed through line 724, valve 722 and line 733 and 734 through bypass valve 735-O and valve 717 back to the compressor 715. In this way the liquid desiccant flowing through regenerator 748 is regenerated by the hot heat transfer fluid circulating through the heat exchanger 720 and the regenerator 748. Concentrated desiccant is directed back to the indoor conditioner 703 where it again picks up moisture. However, conditioner 703 is not receiving a cold heat transfer fluid because the refrigerant circuit bypasses heat exchanger 714 through the valve 735-O. The pump 713 can thus be shut down if desired. The desiccant in conditioner 703 will pick up moisture from the air stream 701 which results in adiabatic heating of the air stream and resulting leaving air 706 that is drier and warmer than the air entering and thus results in simultaneous heating and dehumidification. In this way the space is heated and dehumidified and the compressor is used solely to generate concentrated desiccant to be used by the conditioner. Since the amount of regeneration heat is only proportional to the amount of moisture removed by the conditioner and some components like pump 713 are inactive, this is a very efficiency method of providing dehumidification and heating. It is of course also possible to develop other refrigerant circuits or split the refrigerant circuit into multiple circuits in which some provide active heating and others provide cooling.

Figure 8A:
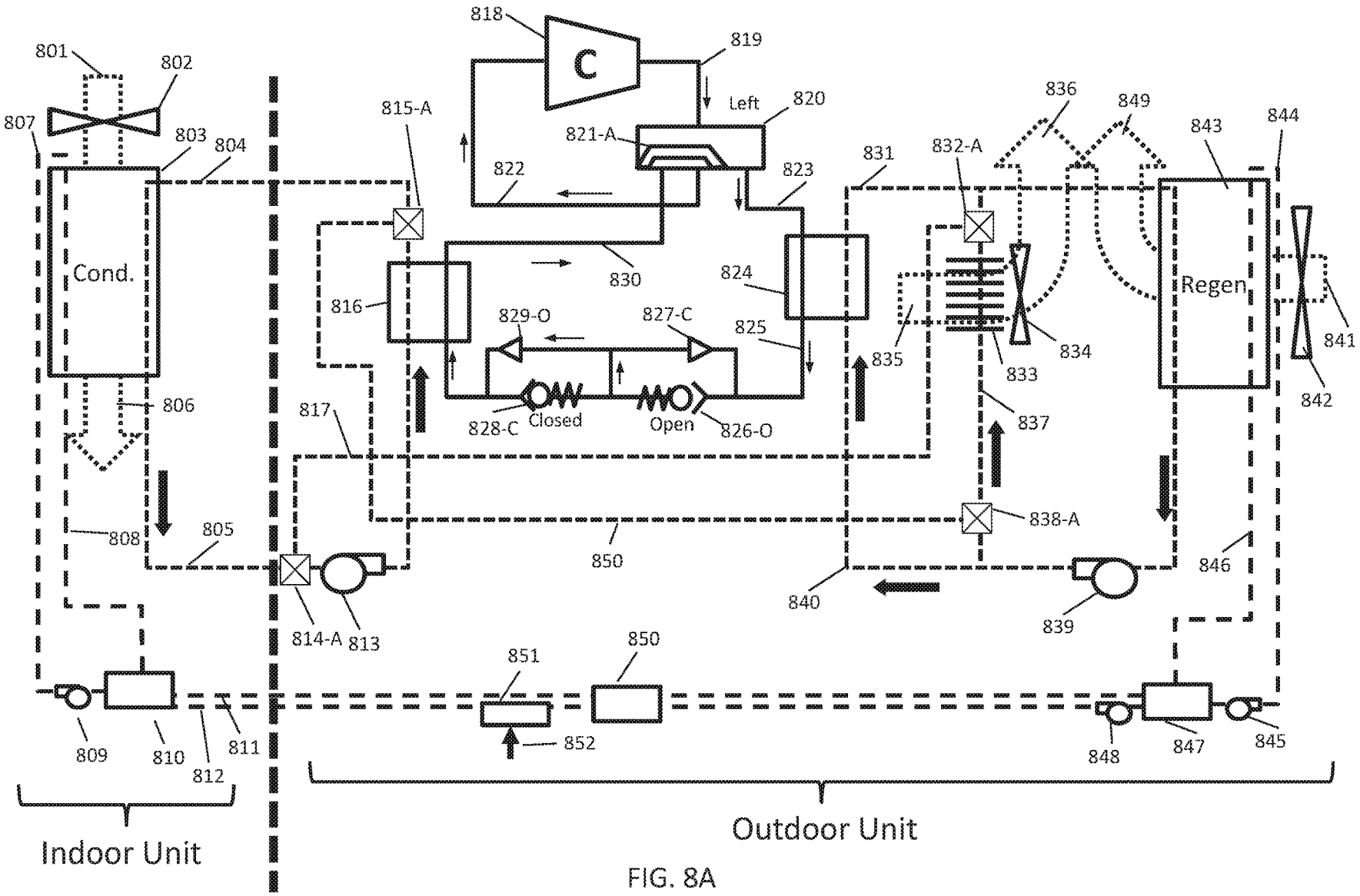
FIG. 8A shows a schematic of an exemplary chiller assisted mini-split liquid desiccant air conditioning system in a summer cooling and dehumidification mode in accordance with one or more embodiments using four 3-way water diverting valves.

FIG. 8A illustrates a hybrid approach between the system of FIG. 6A and that of FIG. 7A. In essence the coil 833 (similar to coil 622 in FIG. 6A and 725 in FIG. 7A) is kept on the heat transfer fluid side thereby allowing hot heat transfer fluid to be directed either to the regenerator plates 843 or to the conditioner plates 803. In the figure, an air stream 801 from the space is directed by fan 802 to a set of membrane conditioner plates 803 such as were earlier described in FIG. 2 and FIG. 3. The conditioner 803 provides an air treatment function and delivers a supply air stream 806 to the space. The conditioner 803 receives a heat transfer fluid (cold in FIG. 8A) through line 804, which allows conditioner 803 to cool and dehumidify the air stream 801. The warmer heat transfer fluid is directed through line 805, valve 814A (in the "A") position and through pump 813 to heat exchanger 816 where it is cooled by a cold refrigerant. The colder heat transfer fluid is then directed through valve 815-A in the "A" position back to conditioner 803. At the same time, conditioner 803 also receives a concentrated liquid desiccant through line 807 which allows the conditioner to absorb moisture from air stream 801 as described elsewhere. The diluted desiccant is directed through line 808 to an optional collection tank 810. Concentrated desiccant is pumped from tank 810 by pump 809 back to the conditioner module 803. Weak, or diluted desiccant is directed through line 811 to optional tank 847 and concentrated desiccant is removed from tank 847 by pump 848 and delivered through line 812 back to tank 810. It is also possible to thermally connect desiccant lines 811 and 812 and form a heat exchanger between the two lines so that heat from the regenerator 843 is not conducted directly to the conditioner 803, which will reduce the energy load on the conditioner. Furthermore it is possible to add a separate liquid desiccant to liquid desiccant heat exchanger 850 instead of thermally connecting lines 811 and 812. An optional water injection system 851 (which is further described in U.S. patent application Ser. No. 14/664,219 incorporated by reference herein) prevents overconcentration of the desiccant in certain conditions by adding water 852 to the desiccant, which also can have the effect of making the system more energy efficient.

Similar to described before in FIG. 6, a compressor 818, provides hot refrigerant gas through line 819 to reversing valve housing 820 with valve 821-A in the "A" position. The hot gas is directed through line 823 to heat exchanger 824 which heats a heat transfer fluid flowing through line 840 and 831. The condensed gas flows through open check valve 826-O while expansion valve 827-C is closed. The refrigerant then flows through expansion valve 829-O where it expands and cools while check valve 828-C is closed. The cold refrigerant now is directed through heat exchanger 816 where is absorbs heat from the heat transfer fluid on the opposite site. The warmed refrigerant is then transported back through line 830 and valve 820 to the compressor 818 through line 822.

As before the hot heat transfer fluid flowing through lines 840 and 831 is picking up heat from the refrigerant in heat exchanger 824. The hot fluid is directed to regenerator 843 which receives an air stream 841 through fan 844 resulting in a hot exhaust air stream 849. Pump 839 moves the heat transfer fluid through line 840 and optionally through line 837 and valve 838-A in the "A" position so the heat transfer fluid is either cooled by air stream 835 and fan 834 in coil 833 resulting in a hot exhaust air stream 836, or simply flowing through line 840 back to the heat exchanger 824. Valve 832A is also in the "A" position and simply directs the cooled heat transfer fluid back into the fluid line 831. The regenerator 843 also receives a diluted, or weak desiccant through line 844 which is re-concentrated by means of the heat transfer fluid coming in through line 831. The re-concentrated desiccant is directed through line 846 into optional desiccant tank 847. Pump 845 removes some diluted desiccant and moves it to the regenerator 843 through line 844. Lines 817 and 850 are not used in this mode.

Figure 8B:
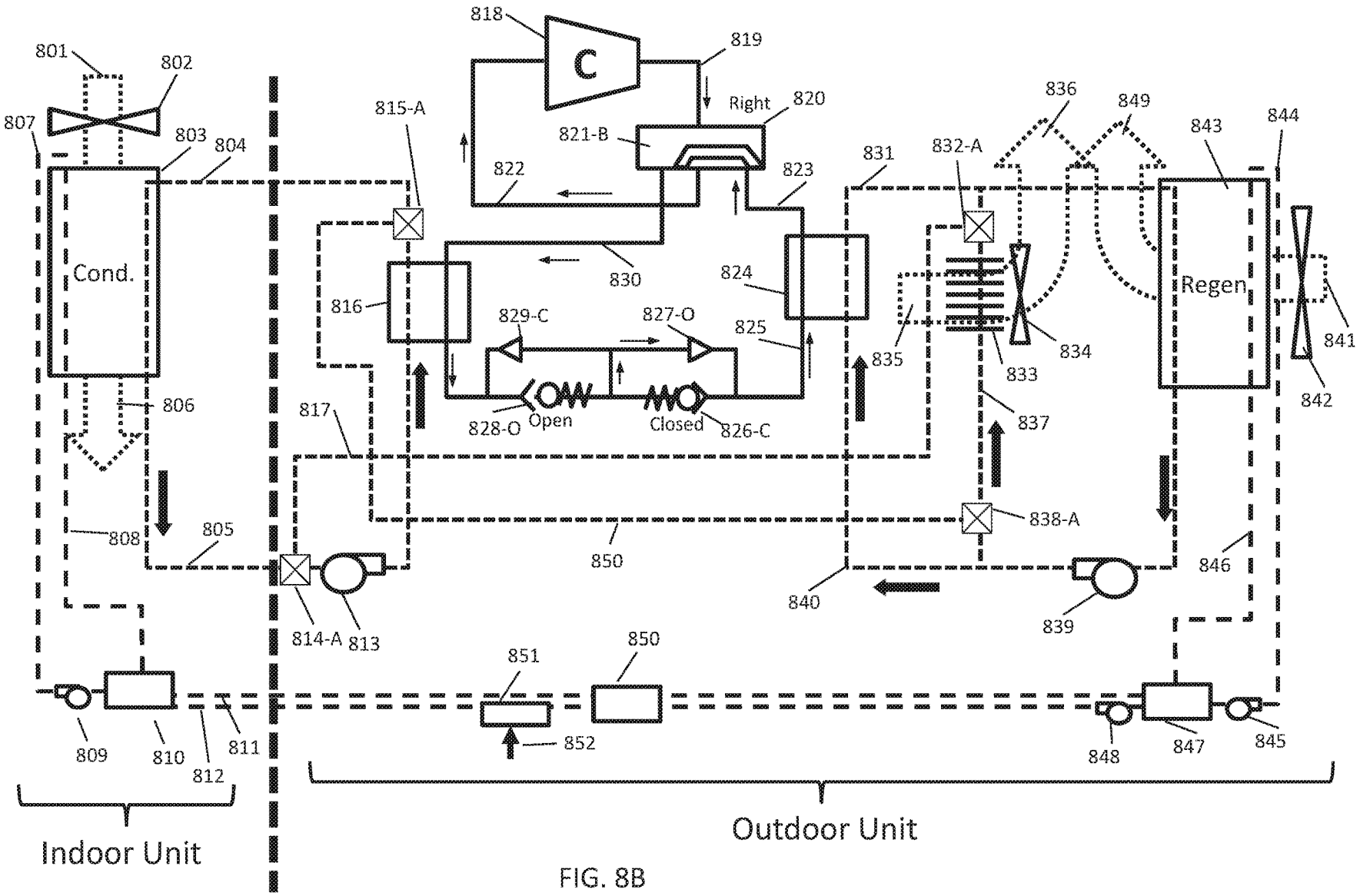
FIG. 8B shows a schematic of an exemplary chiller assisted mini-split liquid desiccant air conditioning system in a winter heating and humidification mode in accordance with one or more embodiments using four 3-way water diverting valves.

FIG. 8B shows the system in FIG. 8A in a winter heating and humidification mode. In essence only the refrigerant valve 821-B has changed from its "A" position to its "B" position. The heat transfer fluid loops are unchanged in this operating mode. The hot refrigerant flows from the compressor 818 through line 819 to valve housing 820 into heat exchanger 816. The resulting hot heat transfer fluid in line 804 drives the conditioner to heat and humidify the air 801 in the space. The condensed refrigerant now enters check valve 828-A, flows to expansion valve 827-O which expands and cools the refrigerant. The cold refrigerant then is directed to heat exchanger 824 where it picks up heat from the heat transfer fluid flowing on the opposite side in lines 840 and 831. As a result, heat is transferred ultimately from the outside air streams 841 and 835 to the indoor space air stream 806. The desiccant in line 844 also picks up moisture from air stream 841 resulting in a weaker desiccant that subsequently makes its way to the conditioner where it helps humidify the air stream 806. As in FIG. 8A, the lines 817 and 840 are not active.

Figure 8C:
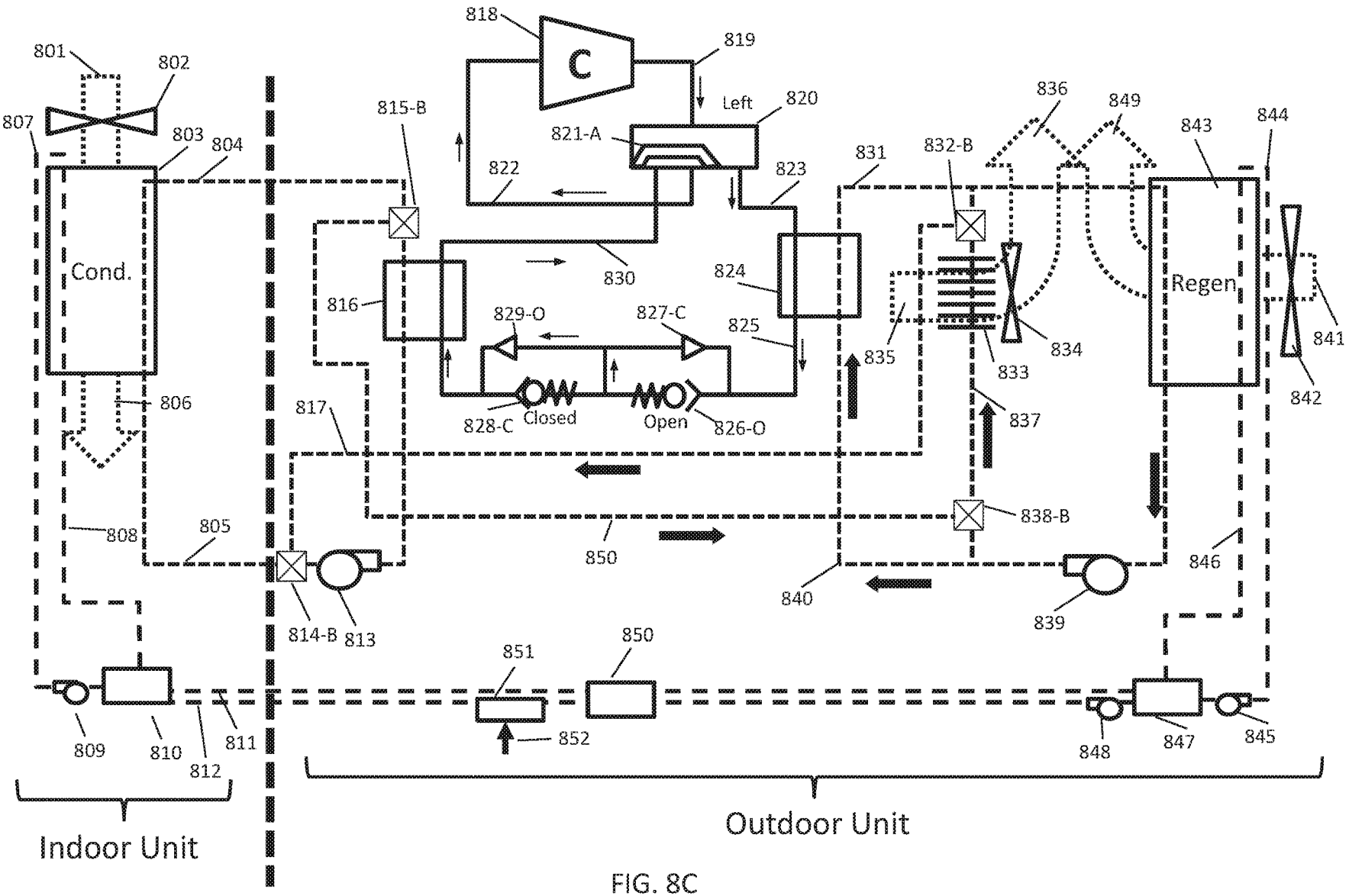
FIG. 8C shows a schematic of an exemplary chiller assisted mini-split liquid desiccant air conditioning system in a shoulder season heating and dehumidification mode in accordance with one or more embodiments using four 3-way water diverting valves.

FIG. 8C illustrates an alternate operating mode wherein refrigerant valve 821 is in the "A" position as in FIG. 8A. Hot refrigerant is again directed to heat exchanger 824 and the heat transfer fluid on the opposite side in line 840 is again heated and directed to the regenerator 843. However valves 814, 815, 832 and 838 have all been switched into their "B" positions. This allows the hot heat transfer fluid to be directed from the regenerator solely back to the refrigerant to liquid heat exchanger 824, but not to coil 833. Instead coil 833 receives cold heat transfer fluid created in heat exchanger 816, which is directed by pump 813 through lines 850 and 817 to the coil 833. As a result the system is effectively pumping heat between heat exchanger 816 which is coupled by the cold heat transfer fluid to coil 833 and heat exchanger 824 which is coupled by the hot heat transfer fluid to the regenerator. As before this results in the indoor air 801 being dehumidified by the concentrated desiccant supplied through line 807, and since no heat transfer fluid is flowing through line 804, this dehumidification will in effect be almost adiabatic resulting in a warm, dry air stream 806. The diluted desiccant can be transported to the regenerator 843 as described before, where the heat of the hot heat transfer fluid causes the desiccant to re-concentrate. It should be clear to those experienced in the art that other water and desiccant circuits can easily be derived that accomplish the same or similar functions.

Figure 9A:
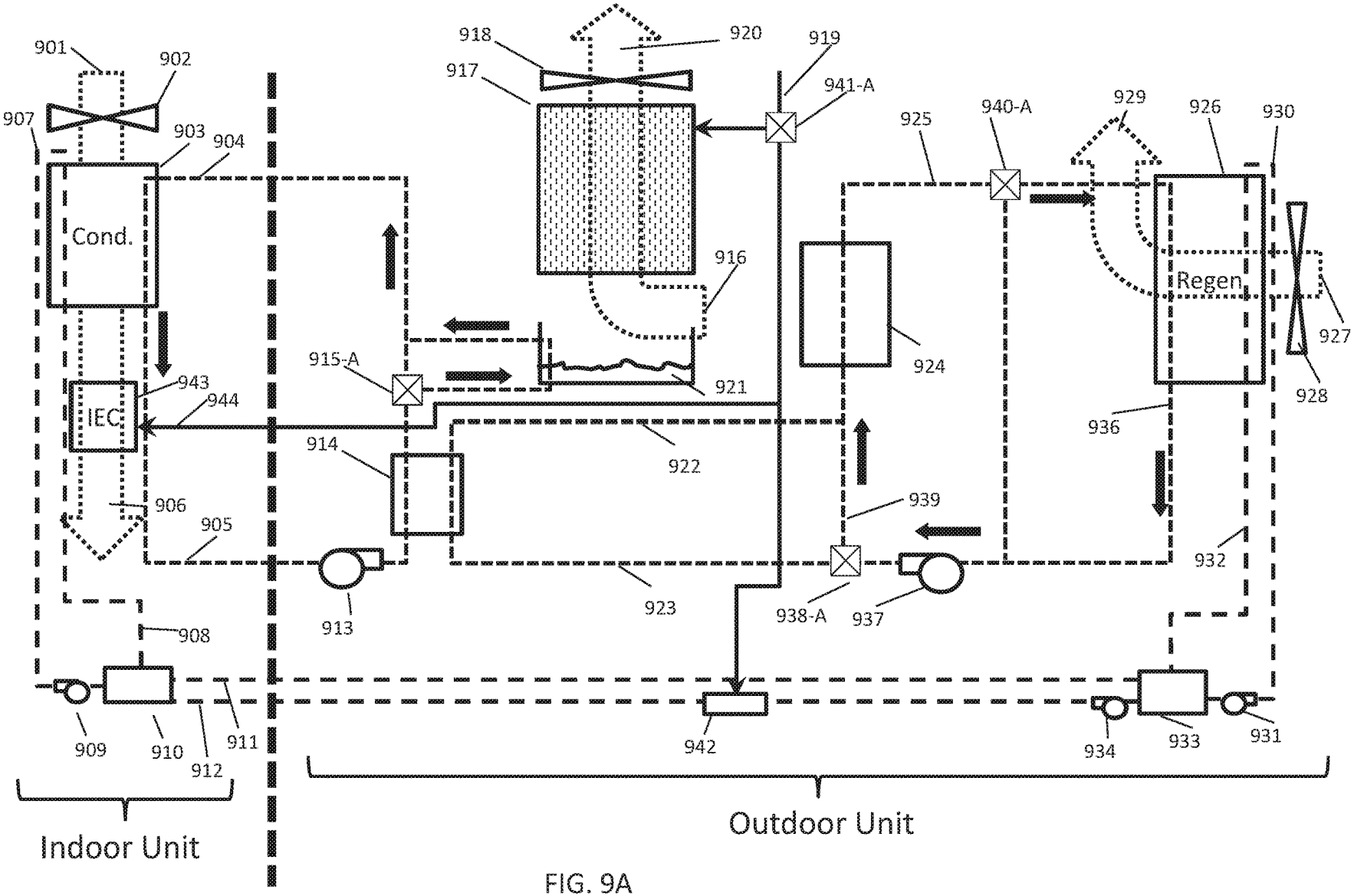
FIG. 9A shows a schematic of an evaporative cooling media and external heat source assisted mini-split desiccant air conditioning system in a summer cooling season mode.

FIG. 9A illustrates a hybrid approach between the system of FIG. 8A but replaces the refrigerant compressor system with a cooling tower or a geothermal loop and a hot water source. In the figure, an air stream 901 from the space is directed by fan 902 to a set of membrane conditioner plates 903 such as were earlier described in FIG. 2 and FIG. 3. The conditioner 903 provides an air treatment function and delivers a supply air stream 906 to the space. The conditioner 903 receives a heat transfer fluid (cold in FIG. 9A) through line 904, which allows conditioner 903 to cool and dehumidify the air stream 901. The warmer heat transfer fluid is directed through line 905, pump 913, heat exchanger 914 where it can be cooled or heated by a heat transfer fluid on the opposite side (however in this mode the heat transfer fluid in line 923 and line 922 is not running), and valve 915A (in the "A") position which directs the heat transfer fluid through a cooling tower basin 921, wherein the heat transfer fluid is cooled. The colder heat transfer fluid is then directed through line 904 back to conditioner 903. At the same time, conditioner 903 also receives a concentrated liquid desiccant through line 907 which allows the conditioner to absorb moisture from air stream 901 similar to what was described before. The diluted desiccant is directed through line 908 to an optional collection tank 910. Concentrated desiccant is pumped from tank 910 by pump 909 back to the conditioner module 903. Weak, or diluted desiccant is directed through line 911 to optional tank 933 and concentrated desiccant is removed from tank 933 by pump 934 and delivered through line 912 back to tank 910.

The cooling tower contains a wetting media 917 and also contains a basin 921 which provides cold water as well as an air intake 916 and fan 918 and an exhaust air stream 920. Make-up water is provided through line 919 and an optional valve 941-A which in the "A" position directs the make-up water to the cooling tower wetting media 917. Valve 941-A can also be switched to deliver water to a water injection unit 942, which can be used to add water to the liquid desiccant flowing in line 912. Such a water injection system is further described in U.S. patent application Ser. No. 14/664,219 incorporated by reference herein and is used to control the desiccant concentration particularly in dry conditions. Valve 941-A could also be replaced with two individual valves if water needs to be delivered to the cooling tower or injection unit at the same time which can be used in hot, dry conditions. In other embodiments, the cooling tower could be replaced with a geothermal loop, in which the heat transfer fluid of line 904 is simply pumped through a geothermal heat exchanger, which is commonly located in the ground or river or lake near the facility where the system is located.

The regenerator 926 receives a hot heat transfer fluid 925 from a heat source 924, which can be any convenient heat source such as a gas-fired water heater, solar hot water system or waste heat collection system. Valve 940-A in the "A" position directs the hot heat transfer fluid 925 to the regenerator 926. The cooler hot heat transfer fluid 936 that is leaving the regenerator is pumped by pump 937 the valve 938-A in the "A" position through line 939 back to the heat source 924. The regenerator 926 also receives a dilute (weak) desiccant through line 930 as well as an air stream 927 moved by fan or blower 928 resulting in a hot, humid exhaust air stream 929. The re-concentrated desiccant flows through line 932 back to tank 933 from where it is send to the conditioner 903 where it is re-used.

It is possible to add a second stage cooling system 943 (labeled IEC Indirect Evaporative Cooler in the figure). The indirect evaporative cooling system 943 provides additional sensible cooling if desired and receives water 944 from the water supply line 919. The IEC may also be used in the various other embodiments disclosed herein to provide additional sensible cooling to the supply air stream.

Figure 9B:
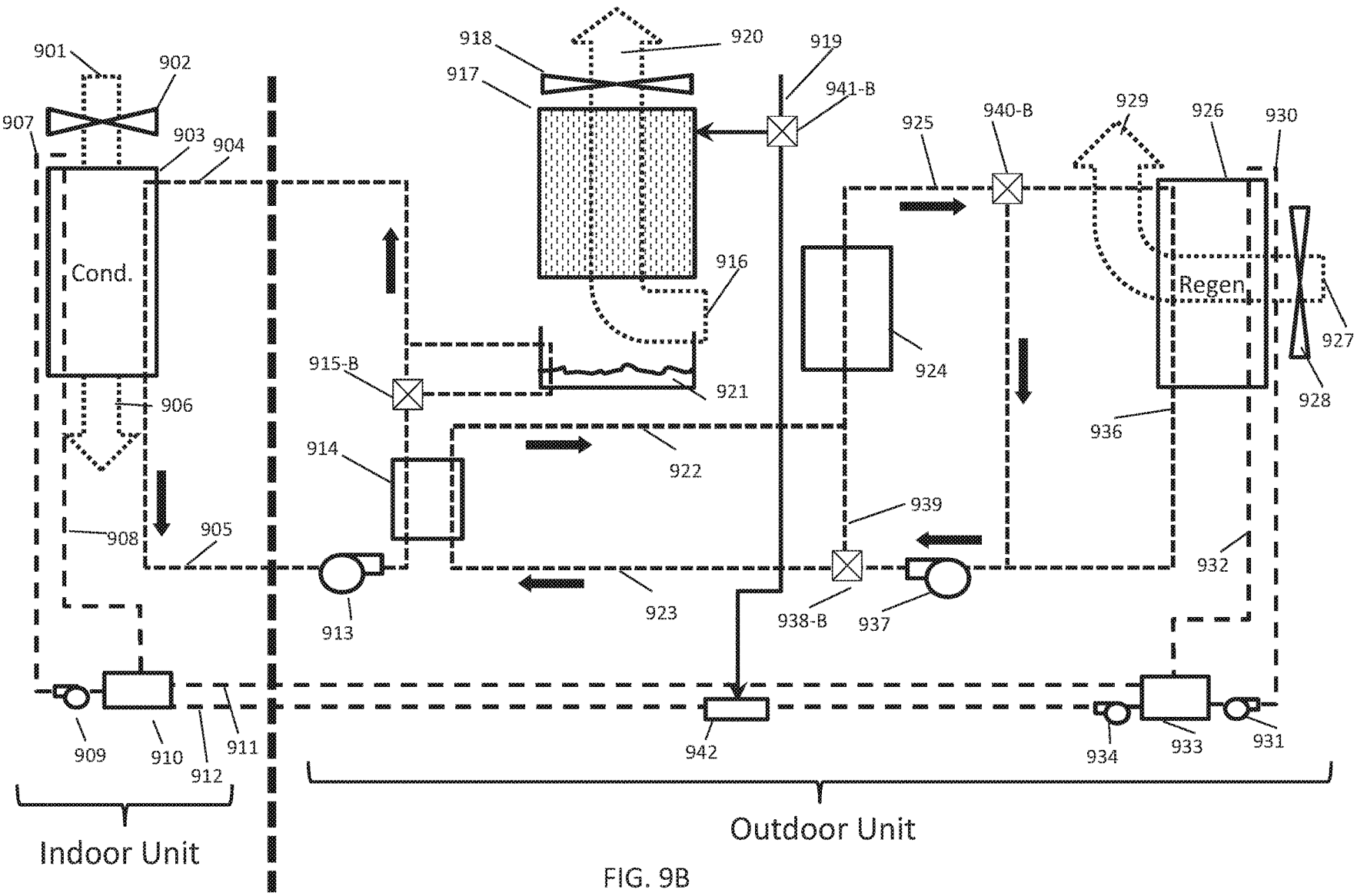
FIG. 9B shows a schematic of an evaporative cooling media and external heat source assisted mini-split desiccant air conditioning system in a winter heating season mode.

FIG. 9B shows the system of FIG. 9A in a winter operating mode. Valves 915-B, 941-B, 940-B and 938-B have all been switched into their "B" positions. Hot heat transfer fluid from heater 924 is diverted by valve 940-B to pump 937 without going to membrane regenerator 926. Valve 938-B directs the hot heat transfer fluid through line 923 to heat exchanger 924 wherein it heat the heat transfer fluid 905 pumped by pump 913. The warmer heat transfer fluid leaving heat exchanger 914 is directed by valve 915-B to the conditioner 903, which in turn results in air stream 906 being warm and moist. The other side of heat exchanger 914 directs its cooler heat transfer fluid through line 922 back to heater 924 wherein it gets heated again.

Concentrated desiccant in line 908 is now directed through optional tank 910 through line 911 to tank 933 where it is pumped by pump 931 to the regenerator. The regenerator will allow the desiccant to absorb moisture assuming that the air stream 927 has enough moisture in it and diluted desiccant will flow through line 932 and tank 933, pump 934 and water injection unit 942 to line 912 back to tank 910 where it can be directed to the conditioner 903 and continue to moisten the air stream 906. If not enough humidity is available in the air stream 927, the water injection module 942 can be used to add water to the desiccant and to eventually moisten the air stream 906 as described more fully in U.S. Patent Application No. 61/968,333.

Figure 9C:
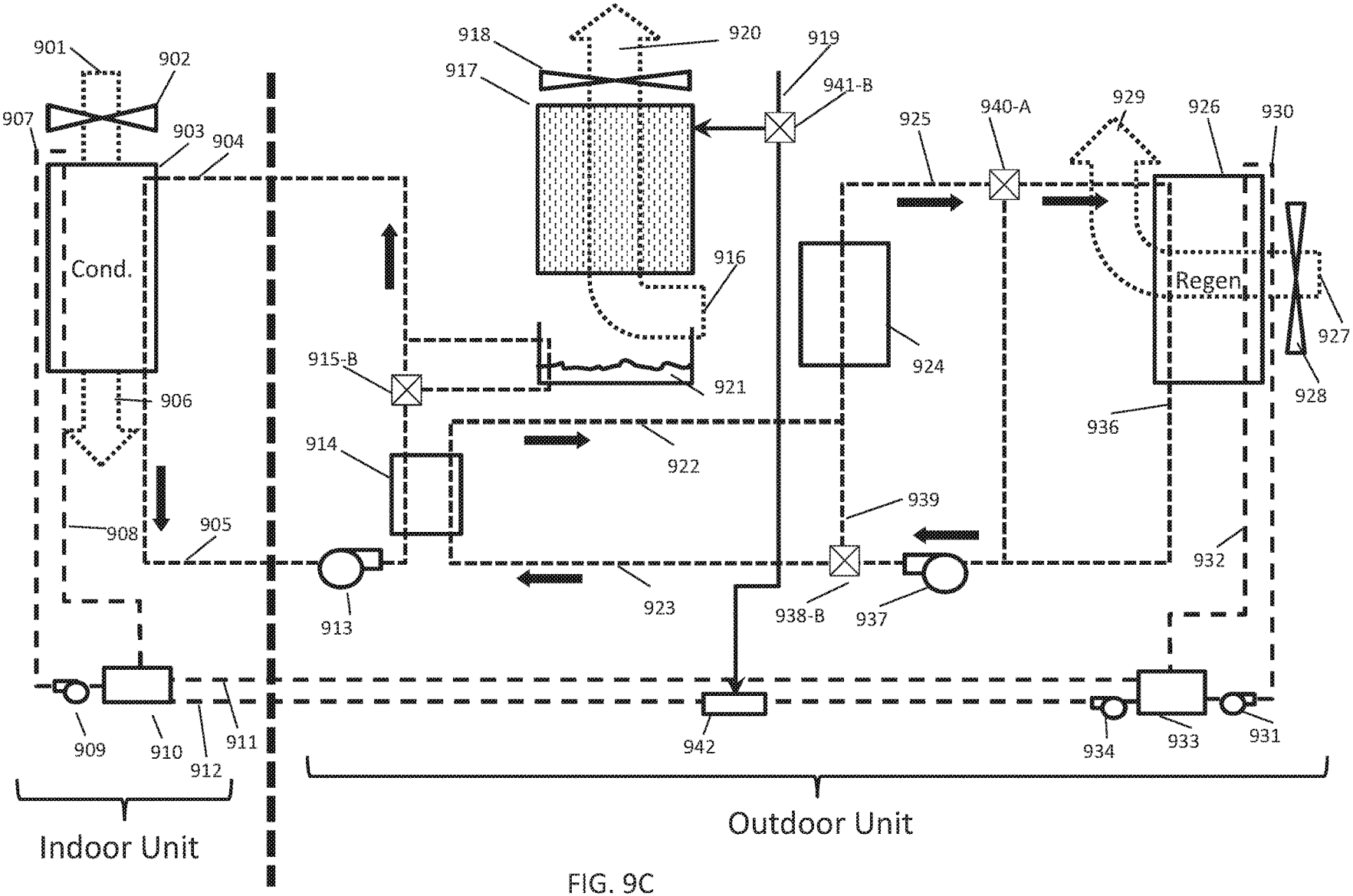
FIG. 9C shows a schematic of an evaporative cooling media and external heat source assisted mini-split desiccant air conditioning system in a shoulder season heating and dehumidification mode.

FIG. 9C shows the system of FIG. 9A in a mode wherein the system provides but heating of air stream 901/906 as well as dehumidification. Valve 940-A is kept in the "A" position as in FIG. 9A and valves 915-B, 938-B and 941-B are kept in their "B" positions. Hot heat transfer fluid from heater 924 now flows through valve 940-A to the regenerator 926. The hot heat transfer fluid results in a hot moist air stream 929 and a concentrated desiccant in line 932, which is directed back through tank 933 and pump 934 through water injection module 942 (inactive) and tank 910 to conditioner 903. The concentrated desiccant is able to absorb moisture from air stream 901. At the same time the cooler hot heat transfer fluid is directed by valve 938-B to heat exchanger 914, resulting in a flow of warm heat transfer fluid through line 904 to the conditioner module. It is of course also possible to switch valve 938-B to the "A" position which would result in the heat transfer fluid bypassing the heat exchanger 914. The pump 913 can then be switched off and conditioner 903 would function as an adiabatic heating system and only desiccant would be provided to the conditioner 903.

Figure 9D:
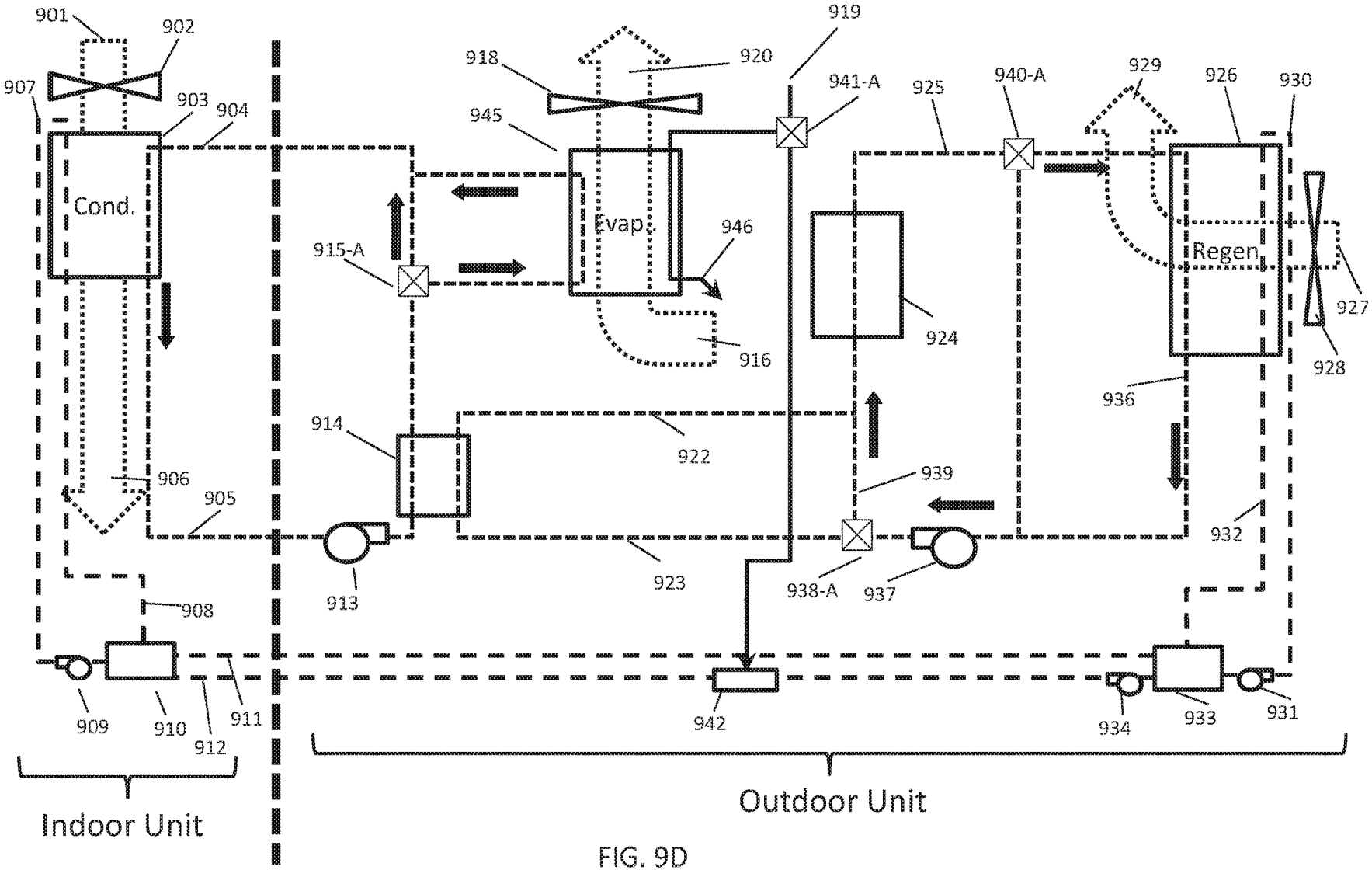
FIG. 9D shows a schematic of the system of FIG. 9A wherein the evaporative cooling media has been replaced with a 3-way membrane module.

The cooling tower wetting media assembly (917) can also be replaced with a set of membrane modules similar to the conditioner membrane modules as is shown in FIG. 9D in a summer cooling mode. In the figure, the heat transfer fluid from the pump 913 is directed to the 3-way membrane module which is similar as described in FIGS. 2 and 3. Valve 915-A directs the heat transfer fluid to the evaporative membrane module 945. Water for evaporation is again provided through line 919 and excess water can drain out through line 946. Since both the evaporative module 945 and the water injection module 942 contain membranes, it is now possible to use seawater or waste water for the evaporation function. This will result in slightly higher temperatures since it is a little harder to evaporate water from seawater (not necessarily so for waste water of course), but using untreated (sea)water for evaporation will significantly reduce the consumption of clean tap water and be economically much more attractive. Replacing the cooling tower with membrane modules is more fully described in application U.S. Patent Application Publication No. US2012/0125021, which is incorporated herein by reference.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

The invention claimed is:

1. A liquid desiccant air-conditioning system operable in a cooling and dehumidification mode, a heating and humidification mode, and/or a heating and dehumidification mode, the system comprising:

a conditioner for treating a first air stream flowing therethrough and provided to a space, said conditioner using a heat transfer fluid and a liquid desiccant to cool and dehumidify the first air stream in the cooling and dehumidification mode, heat and humidify the first air stream in the heating and humidification mode, and heat and dehumidify the first air stream in the heating and dehumidification mode;

a regenerator connected to the conditioner such that the liquid desiccant can be circulated between the regenerator and the conditioner, the regenerator causing the liquid desiccant to desorb water vapor to a second air stream in the cooling and dehumidification mode and in the heating and dehumidification mode;

a refrigerant system including at least one compressor, at least one expansion valve for processing a refrigerant, and a refrigerant-to-air heat exchanger for exchanging heat between the refrigerant and a third air stream;

a first refrigerant-to-heat transfer fluid heat exchanger connected to the conditioner and the refrigerant system for exchanging heat between the refrigerant heated or cooled by the refrigerant system and the heat transfer fluid used in the conditioner;

a second refrigerant-to-heat transfer fluid heat exchanger connected to the regenerator and the refrigerant system for exchanging heat between the refrigerant heated or cooled by the refrigerant system and the heat transfer fluid used in the regenerator; and a valve system for selectively controlling flow of the refrigerant among the at least one compressor, the at least one expansion valve, the first refrigerant-to-heat transfer fluid heat exchanger, the second refrigerant-to-heat transfer fluid heat exchanger, and the refrigerant-to-air heat exchanger in accordance with a given mode of operation of the air-conditioning system.

2. The liquid desiccant air-conditioning system of claim 1, wherein the regenerator is configured to cause the liquid desiccant to absorb water vapor from the second air stream in the heating and humidification mode or wherein the system further comprises a water injection system to add water to the liquid desiccant when operating in the heating and humidification mode.

3. The liquid desiccant air-conditioning system of claim 1, wherein in the cooling and dehumidification mode, the valve system directs the refrigerant in the refrigerant system from the compressor to the second refrigerant-to-heat transfer fluid heat exchanger and the refrigerant-to-air heat exchanger in series or in parallel, to the at least one expansion valve, to the first refrigerant-to-heat transfer fluid heat exchanger, and back to the compressor.

4. The liquid desiccant air-conditioning system of claim 1, wherein in the heating and humidification mode, the valve system directs the refrigerant in the refrigerant system from the compressor to the first refrigerant-to-heat transfer fluid heat exchanger, to the at least one expansion valve, to the second refrigerant-to-heat transfer fluid heat exchanger and the refrigerant-to-air heat exchanger in series or in parallel, and back to the compressor.

5. The liquid desiccant air-conditioning system of claim 1, wherein in the heating and dehumidification mode, the valve system directs the refrigerant in the refrigerant system from the compressor to the second refrigerant-to-heat transfer fluid heat exchanger, to the at least one expansion valve, to the refrigerant-to-air heat exchanger, and back to the compressor.

6. The liquid desiccant air-conditioning system of claim 5, wherein in the heating and dehumidification mode, the first refrigerant-to-heat transfer fluid heat exchanger is inactive and wherein the first air stream dehumidifies adiabatically in the conditioner such that warm dry air is output by the conditioner.

7. The liquid desiccant air-conditioning system of claim 1, wherein the liquid desiccant air-conditioning system is operable in each of the cooling and dehumidification mode, the heating and humidification mode, and the heating and dehumidification mode.

8. The liquid desiccant air-conditioning system of claim 1, wherein the air-conditioning system is a mini-split system in which the conditioner comprises an indoor unit, and the regenerator and the refrigerant system are outdoor units.

9. The liquid desiccant air-conditioning system of claim 1, wherein the conditioner includes a plurality of structures arranged in a substantially parallel orientation, each structure having at least one surface across which the liquid desiccant can flow, wherein the first air stream flows between the structures such that the liquid desiccant dehumidifies or humidifies the first air stream depending on the mode of operation, each structure further includes a desiccant collector at an end of the at least one surface for collecting liquid desiccant that has flowed across the at least one surface of the structure.

10. The liquid desiccant air-conditioning system of claim 9, wherein each of the plurality of structures includes a passage through which the heat transfer fluid can flow.

11. The liquid desiccant air-conditioning system of claim 9, further comprising a sheet of material positioned proximate to the at least one surface of each structure between the liquid desiccant and the first air stream, said sheet of material guiding the liquid desiccant into the desiccant collector of the structure and permitting transfer of water vapor between the liquid desiccant and the first air stream.

12. The liquid desiccant air-conditioning system of claim 1, wherein the regenerator includes a plurality of structures arranged in a substantially parallel orientation, each structure having at least one surface across which the liquid desiccant can flow, wherein the second air stream flows between the structures such that the liquid desiccant dehumidifies or humidifies the third air stream depending on the mode of operation, each structure further includes a desiccant collector at an end of the at least one surface for collecting liquid desiccant that has flowed across the at least one surface of the structure.

13. The liquid desiccant air-conditioning system of claim 12, wherein each of the plurality of structures includes a passage through which the heat transfer fluid can flow.

14. The liquid desiccant air-conditioning system of claim 12, further comprising a sheet of material positioned proximate to the at least one surface of each structure between the liquid desiccant and the third air stream, said sheet of material guiding the liquid desiccant into the desiccant collector of the structure and permitting transfer of water vapor between the liquid desiccant and the second air stream.

15. The liquid desiccant air-conditioning system of claim 1, further comprising a liquid desiccant-to-liquid desiccant heat exchanger for exchanging heat between the liquid desiccant flowing from the conditioner to the regenerator and the liquid desiccant flowing from the regenerator to the conditioner.

16. The liquid desiccant air-conditioning system of claim 1, further comprising a water injection module for adding water into the liquid desiccant to prevent overconcentration of the liquid desiccant.

17. The liquid desiccant air-conditioning system of claim 1, wherein the valve system comprises one 4-way valve, three 3-way valves, and two flow controllers.

18. The liquid desiccant air-conditioning system of claim 1, wherein the valve system comprises two staggered 4-way valves.

19. The liquid desiccant air-conditioning system of claim 1, further comprising an indirect evaporative cooler for providing additional sensible cooling of the first air stream after exiting the conditioner.

20. A liquid desiccant air-conditioning system operable in a cooling and dehumidification mode, a heating and humidification mode, and/or a heating and dehumidification mode, the system comprising:

a conditioner for treating a first air stream flowing therethrough and provided to a space, said conditioner using a heat transfer fluid and a liquid desiccant to cool and dehumidify the first air stream in the cooling and dehumidification mode, heat and humidify the first air stream in the heating and humidification mode, and heat and dehumidify the first air stream in the heating and dehumidification mode;

a regenerator connected to the conditioner such that the liquid desiccant can be circulated between the regenerator and the conditioner, the regenerator causing the liquid desiccant to desorb water vapor to a second air stream in the cooling and dehumidification mode and in the heating and dehumidification mode;

a heating and cooling system including a heating apparatus and a cooling apparatus; and a valve system for controlling flow of the heat transfer fluid used in the conditioner such that the heat transfer fluid is selectively heated by the heating apparatus or cooled by the cooling apparatus, and controlling flow of the heat transfer fluid used in the regenerator such that it is selectively heated by the heating apparatus.

21. The liquid desiccant air-conditioning system of claim 20, wherein the regenerator is configured to cause the liquid desiccant to absorb water vapor from the second air stream in the heating and humidification mode or wherein the system further comprises a water injection system to add water to the liquid desiccant when operating in the heating and humidification mode.

22. The liquid desiccant air-conditioning system of claim 20, wherein in the cooling and dehumidification mode, the valve system directs the heat transfer fluid used in the conditioner such that it is cooled by the cooling apparatus, and directs the heat transfer fluid used in the regenerator such that it is heated by the heating apparatus.

23. The liquid desiccant air-conditioning system of claim 20, wherein in the heating and humidification mode, the valve system directs the heat transfer fluid used in the conditioner such that it is heated by the heating apparatus, and the heating apparatus does not heat the heat transfer fluid used in the regenerator.

24. The liquid desiccant air-conditioning system of claim 20, wherein in the heating and dehumidification mode, the valve system directs heat transfer fluid for the conditioner such that it is heated by the heating apparatus, and directs the heat transfer fluid used in the regenerator such that it is heated by the heating apparatus.

25. The liquid desiccant air-conditioning system of claim 20, wherein the cooling apparatus comprises a cooling tower, an evaporative cooler, or a geothermal loop including a geothermal heat exchanger.

26. The liquid desiccant air-conditioning system of claim 20, wherein the cooling apparatus comprises an evaporative cooler including a plurality of structures arranged in a substantially vertical orientation, each structure having at least one surface across which water for evaporation can flow, wherein a third air stream flows between the structures such that the water for evaporation humidifies the third air stream, and wherein a sheet of material is positioned proximate to the at least one surface of each structure between the water for evaporation and the third air stream, said sheet of material permitting transfer of water vapor from the water for evaporation to the third air stream, and wherein the water for evaporation comprises sea water or wastewater.

27. The liquid desiccant air-conditioning system of claim 20, wherein the liquid desiccant air-conditioning system is selectively operable in each of the cooling and dehumidification mode, the heating and humidification mode, and the heating and dehumidification mode.

28. The liquid desiccant air-conditioning system of claim 20, wherein the air-conditioning system is a mini-split system in which the conditioner comprises an indoor unit, and the regenerator and the heating and cooling system are outdoor units.

29. The liquid desiccant air-conditioning system of claim 20, wherein the conditioner includes a plurality of structures arranged in a substantially parallel orientation, each structure having at least one surface across which the liquid desiccant can flow, wherein the first air stream flows between the structures such that the liquid desiccant dehumidifies or humidifies the first air stream depending on the mode of operation, each structure further includes a desiccant collector at an end of the at least one surface for collecting liquid desiccant that has flowed across the at least one surface of the structure.

30. The liquid desiccant air-conditioning system of claim 29, wherein each of the plurality of structures includes a passage through which the heat transfer fluid can flow.

31. The liquid desiccant air-conditioning system of claim 29, further comprising a sheet of material positioned proximate to the at least one surface of each structure between the liquid desiccant and the first air stream, said sheet of material guiding the liquid desiccant into the desiccant collector of the structure and permitting transfer of water vapor between the liquid desiccant and the first air stream.

32. The liquid desiccant air-conditioning system of claim 20, wherein the regenerator includes a plurality of structures arranged in a substantially vertical orientation, each structure having at least one surface across which the liquid desiccant can flow, wherein the second air stream flows between the structures such that the liquid desiccant dehumidifies or humidifies the second air stream depending on the mode of operation, each structure further includes a desiccant collector at a lower end of the at least one surface for collecting liquid desiccant that has flowed across the at least one surface of the structure.

33. The liquid desiccant air-conditioning system of claim 32, wherein each of the plurality of structures includes a passage through which the heat transfer fluid can flow.

34. The liquid desiccant air-conditioning system of claim 32, further comprising a sheet of material positioned proximate to the at least one surface of each structure between the liquid desiccant and the second air stream, said sheet of material guiding the liquid desiccant into the desiccant collector of the structure and permitting transfer of water vapor between the liquid desiccant and the second air stream.

35. The liquid desiccant air-conditioning system of claim 20, further comprising an indirect evaporative cooler for providing additional sensible cooling of the first air stream after exiting the conditioner.

36. The liquid desiccant air-conditioning system of claim 20, further comprising a liquid desiccant-to-liquid desiccant heat exchanger for exchanging heat between the liquid desiccant flowing from the conditioner to the regenerator and the liquid desiccant flowing from the regenerator to the conditioner.

37. The liquid desiccant air-conditioning system of claim 20, further comprising a water injection module for adding water into the liquid desiccant to prevent overconcentration of the liquid desiccant.

38. A method of operating a liquid desiccant air-conditioning system in a cooling and dehumidification mode, a heating and humidification mode, and a heating and dehumidification mode, the method comprising:

adjusting a valve system in the liquid desiccant air-conditioning system such that (a) in the cooling and dehumidification mode: a supply air stream is cooled using a heat transfer fluid and dehumidified using a liquid desiccant in a conditioner, the liquid desiccant used in the conditioner is regenerated in a regenerator, and the heat transfer fluid used in the conditioner is cooled in a refrigerant system; (b) in the heating and humidification mode: the supply air stream is heated using the heat transfer fluid and humidified using the liquid desiccant in the conditioner, the liquid desiccant used in the conditioner is diluted with water in the regenerator or a water injection system, and the heat transfer fluid used in the conditioner is heated in the refrigerant system; and (c) in the heating and dehumidification mode: the supply air stream is heated and dehumidified using the liquid desiccant in the conditioner, and the liquid desiccant used in the conditioner is regenerated in the regenerator.

39. The method of claim 38, wherein in the cooling and dehumidification mode, the valve system is adjusted to direct a refrigerant in the refrigerant system from a compressor to a heat exchanger for heating the heat transfer fluid used in the regenerator and/or heating an air stream in a refrigerant to air heat exchanger, to an expansion valve, to a heat exchanger for cooling the heat transfer fluid used in the conditioner, and back to the compressor.

40. The method of claim 38, wherein in the heating and humidification mode, the valve system is adjusted to direct a refrigerant in a refrigerant system from the compressor to a heat exchanger for heating the heat transfer fluid used in the conditioner, to an expansion valve, to a heat exchanger for cooling the heat transfer fluid used in the regenerator and/or cooling an air stream in a refrigerant to air heat exchanger, and back to the compressor.

41. The method of claim 38, wherein in the heating and dehumidification mode, the valve system is adjusted to direct a refrigerant in the refrigerant system from a compressor to a heat exchanger for heating the heat transfer fluid used in the regenerator, to an expansion valve, to a refrigerant-to-air heat exchanger, and back to the compressor.

* * * * *